US009562302B2

(12) United States Patent
Gao et al.

(10) Patent No.: US 9,562,302 B2
(45) Date of Patent: Feb. 7, 2017

(54) PLATING OR COATING METHOD FOR PRODUCING METAL-CERAMIC COATING ON A SUBSTRATE

(75) Inventors: Wei Gao, Auckland (NZ); Weiwei Chen, Auckland (NZ)

(73) Assignee: AUCKLAND UNISERVICES LIMITED, Auckland (NZ)

( * ) Notice: Subject to any disclaimer, the term of this patent is extended or adjusted under 35 U.S.C. 154(b) by 1092 days.

(21) Appl. No.: 13/381,487

(22) PCT Filed: Jun. 29, 2010

(86) PCT No.: PCT/NZ2010/000128
§ 371 (c)(1),
(2), (4) Date: Dec. 29, 2011

(87) PCT Pub. No.: WO2011/002311
PCT Pub. Date: Jan. 6, 2011

(65) Prior Publication Data

US 2012/0107627 A1 May 3, 2012

(30) Foreign Application Priority Data

Jun. 29, 2009 (NZ) ..... 578038

(51) Int. Cl.
*C23C 18/16* (2006.01)
*C25D 15/02* (2006.01)
(Continued)

(52) U.S. Cl.
CPC ..... *C25D 15/02* (2013.01); *C23C 18/1637* (2013.01); *C23C 18/1662* (2013.01); *C23C 18/31* (2013.01);
(Continued)

(58) Field of Classification Search
CPC ... C23C 18/16–18/54; C01G 23/053–23/0538; C25D 21/18
(Continued)

(56) References Cited

U.S. PATENT DOCUMENTS 3,617,363 A 11/1971 Metzger et al.
5,116,430 A * 5/1992 Hirai et al. ..... 148/518
(Continued)

FOREIGN PATENT DOCUMENTS

CN 101397657 4/2009
DE 4424168 1/1996
(Continued)

OTHER PUBLICATIONS

Hamid and Elkhair, Development of Electroless Nickel-Phosphorous Composite Deposits for Wear Resistance of 6061 Aluminum Alloy, 57 Mat'ls Letters 720 (2002).*
(Continued)

*Primary Examiner* — James Lin
*Assistant Examiner* — Ho-Sung Chung
(74) *Attorney, Agent, or Firm* — Dann, Dorfman, Herrell and Skillman, P.C.

(57) ABSTRACT

A method for producing a metal-ceramic composite coating with increased hardness on a substrate includes adding a sol of a ceramic phase to the plating solution or electrolyte. The sol may be added prior to and/or during the plating or coating and at a rate of sol addition controlled to be sufficiently low that nanoparticles of the ceramic phase form directly onto or at the substrate and/or that the metal-ceramic coating forms on the substrate with a predominantly crystalline structure and/or to substantially avoid formation of nanoparticles of the ceramic phase, and/or agglomeration of particles of the ceramic phase, in the plating solution or electrolyte. The ceramic phase may be a single or mixed
(Continued)

oxide, carbide, nitride, silicate, boride of Ti, W, Si, Zr, Al, Y, Cr, Fe, Pb, Co, or a rare earth element. The coating, other than the ceramic phase may comprise Ni, Ni—P, Ni—W—P, Ni—Cu—P, Ni—B, Cu, Ag, Au, Pd.

23 Claims, 20 Drawing Sheets

(51) Int. Cl.

| | |
|---|---|
| ***C23C 18/31*** | (2006.01) |
| ***C25D 21/14*** | (2006.01) |
| *C25D 3/12* | (2006.01) |
| *C25D 3/56* | (2006.01) |

(52) U.S. Cl.
CPC ..... *C25D 21/14* (2013.01); *C25D 3/12* (2013.01); *C25D 3/562* (2013.01)

(58) Field of Classification Search
USPC ..... 205/109–110
See application file for complete search history.

(56) References Cited

U.S. PATENT DOCUMENTS

| | | | | |
|---|---|---|---|---|
| 5,266,181 | A * | 11/1993 | Matsumura et al. | 205/109 |
| 5,935,403 | A | 8/1999 | Suzuki et al. | |
| 6,077,815 | A * | 6/2000 | Grunthaler | C22C 32/00 156/150 |
| 6,183,908 | B1 * | 2/2001 | Miyasaka | H01M 4/485 423/618 |

FOREIGN PATENT DOCUMENTS

| | | |
|---|---|---|
| EP | 0441636 | 8/1991 |
| EP | 1020542 | 7/2000 |
| EP | 2103718 | 9/2009 |
| GB | 824092 | 11/1959 |
| JP | 59-123796 | 7/1984 |
| JP | 63282294 | 11/1988 |
| JP | 03253598 | 12/1991 |
| JP | 05-171454 | 7/1993 |
| JP | 8120457 | 5/1996 |
| WO | 2009017266 | 2/2009 |

OTHER PUBLICATIONS

Xu et al., Synthesis and Properties of Electroless Ni—P-Nanometer Diamond Composite Coatings, 191 Surface & Coatings Tech. 161 (2005).*
Song et al., Primary Investigation of Corrosion Resistance of Ni—P/TiO2 Composite Film on Sintered NdFeB Permanent Magnet, 202 Surface & Coatings Tech. 5146 (2008).*
McKeen, Fluorinated Coatings and Finishes Handbook 54 (2006).*
Bard, Electrochemical Methods 18 (2001).*
Haoying Ling et al., "Preparation of organic-inorganic multifunctional nanocomposite coating via sol-gel routes," Journal of Nanoparticle Research 3: pp. 157-160, 2001.
Reut Toledano et al., "Electrochemical Co-deposition of Sol-Gel/Metal Thin Nanocomposite Films," Chem. Mater. 2008, 20, pp. 4276-4283.
Xia Changrong et al., "Preparation of asymmetric Ni/ceramic composite membrane by electroless plating," A: Physicochemical and Engineering Aspects 179 (2001), pp. 229-235.
B.M. Praveen et al., "Electrodeposition and properties of Zn-nanosized TiO2 composite coatings," Applied Surface Science 254 (2008), pp. 2418-2424.
M.C. Cheung et al., "Characterization of Barium Titanate Ceramic/Ceramic Nanocomposite Films Prepared by a Sol-Gel Process," NanoStructured Materials, vol. 11, No. 7, pp. 837-844, 1999.
Tuo Li et al., "Preparation of Ag/SiO2 Nanosize Composite by a Reverse Micelle and Sol-Gel Technique," Langmuir 1999, 15, pp. 4328-4334.
Helmut K. Schmidt, "Nanoparticles for Ceramic Nanocomposite Processing," Mol. Cryst. Lid. Cryst., 2000; 353, pp. 165-179.
Laima Luo et al., "Preparation and characterization of sol-gel Al2O3/Ni—P composite coatings on carbon steel," Ceramics International 35 (2009), pp. 2741-2745.
Laizhou Song et al., "Primary investigation of corrosion resistance of Ni—P/TiO2 composite film on sintered NdFeB permanent magnet," Surface & Coatings Technology 202 (2008), pp. 5146-5150.
H.K. Schmidt et al., "Aqueous Sol-Gel Derived Nanocomposite Coating Materials," Organic/Inorganic Hybrid Materials (1998), pp. 297-308.
Goutam De, "Sol-Gel Synthesis of Metal Nanocluster-Silica Composite Films," Journal of Sol-Gel Science and Technology 11 (1998), pp. 289-298.
Yunfa Chen et al., "Sol-Gel Processing of Organic-Inorganic Nanocomposite Protective Coatings," Journal of Sol-Gel Science and Technology 13 (1998), pp. 735-738.
Lai Zhou Song et al., "Modification and Anticorrosion Property of Carbon Steel with TiO2 Film," J. Iron & Steel Res. Int., vol. 12, No. 6, (Nov. 2005), pp. 37-41.
Laizhou Song et al., "Formation of TiO2 Modified Film on Carbon Steel," J. Mater. Sci. Technol., 20: (2004), pp. 599-601.
Malina Raileanu et al., ":Sol-gel doped TiO2 nanomaterials: a comparative study," J. Sol-Gel Sci. Technol., 51: (2009), pp. 315-329.
N.J. Tang et al., "Synthesis and magnetic properties of Fe/SiO2 nanocomposites prepared by a sol-gel method combined with hydrogen reduction," Journal of Alloys and Compounds 419 (2006), pp. 145-148.
M.D. Soucek et al., "Inorganic/Organic Nanocomposite Coatings: The Next Step in Coating Performance," JCT Research, vol. 3, No. 2, Apr. 2006, pp. 133-140.
M.F. Casula et al., "Characterization of FeCo—SiO2 Nanocomposite Films Prepared by Sol-Gel Dip Coating," Chem. Mater. 2003, 15, pp. 2201-2207.
G. Mattei et al., "Synthesis, Structure, and Magnetic Properties of Co, Ni, and Co—Ni Alloy Nanocluster-Doped SiO2 Films by Sol-Gel Processing," Chem. Mater. 2002, 14, pp. 3440-3447.
H.K. Schmidt et al., "Aqueous Sol-Gel Derived Nanocomposite Coating Materials," Organic/Inorganic Hybrid Materials, 1998, pp. 297-308.
European Search Report, EP Appln. No. 10794416.7, Aug. 16, 2016, pp. 1-9.

* cited by examiner

A: Ni-P B: Ni-P $ZrO_2$ powder C: Ni-P $ZrO_2$ $sol_{0.51}$

PLATING OR COATING METHOD FOR PRODUCING METAL-CERAMIC COATING ON A SUBSTRATE

FIELD OF INVENTION

The invention relates to an improved plating or coating method for producing a metal-ceramic composite coating on a substrate.

BACKGROUND

In electroplating sometimes referred to as electrodeposition, a conductive item to be metal plated which forms a cathode, and an anode, are immersed in an electrolyte containing one or more dissolved metal salts, and a battery or rectifier supplies direct current. In one method the anode is of the plating metal and metal molecules of the anode are oxidised and dissolved into the electrolyte and at the cathode the dissolved metal ions are reduced and plated onto the cathode/item. In another method the anode is not consumable and ions of the plating metal are provided in the electrolyte and must be periodically replenished.

Electroless plating or deposition is a non-galvanic plating or coating method in which a reducing agent, typically sodium hypophosphite, in aqueous solution reduces metal ions of the plating metal in solution from the anode, which deposit onto the cathode/item. Electroless nickel plating may be used to deposit a coating of nickel Ni—P or Ni—B onto a substrate which may be a metal or plastic substrate.

Electroless plating may also be used to form a metal-ceramic composite coating on a substrate, such as an Ni—P—$TiO_2$ coating for example. $TiO_2$ nanoparticles are added to the electroless plating solution and co-deposit on the substrate with the Ni—P in an Ni—P—$TiO_2$ matrix. The $TiO_2$ particles can tend to agglomerate together in solution and thus distribute non-uniformly on the substrate thus giving uneven properties to the coating, and with the objective of reducing this the solution is continuously stirred and/or a surfactant is added to assure good dispersion of the $TiO_2$ particles through the solution.

Ni—P—$TiO_2$ coatings may also be formed on a substrate or item by first forming a coating of Ni—P on the item by electroplating and then dipping the item into a $TiO_2$ sol to deposit $TiO_2$ on/in the coating by the sol-gel process.

Plating or coating of an item or surface is typically carried out to provide a desired property to a surface that otherwise lacks that property or to improve a property to a desired extent, such as abrasion or wear resistance, corrosion resistance, or a particular appearance, for example.

SUMMARY OF INVENTION

In broad terms in one aspect the invention comprises a method for producing a metal-ceramic composite coating on a substrate which includes adding a sol of a ceramic phase to the plating solution or electrolyte.

The invention also comprises a plating or coating method for producing a metal-ceramic composite coating on a substrate, which includes adding a ceramic phase to the plating solution or electrolyte as a sol in an amount sufficiently low that nanoparticles of the ceramic phase form directly onto or at the substrate. The invention also comprises a plating or coating method for producing a metal-ceramic composite coating on a substrate which includes adding a ceramic phase to the plating solution or electrolyte as a sol in an amount sufficiently low that the metal-ceramic coating forms on the substrate with a predominantly crystalline structure.

The invention also comprises a plating or coating method for producing a metal-ceramic composite coating on a substrate which includes adding a ceramic phase to the plating solution as a sol in an amount sufficiently low as to substantially avoid formation of nanoparticles of the ceramic phase, and/or agglomeration of particles of the ceramic phase, in the plating solution or electrolyte.

In certain embodiments the sol is added while carrying out the plating or coating and at a rate of sol addition controlled to be sufficiently low that nanoparticles of the ceramic phase form directly onto or at the substrate and/or that the metal-ceramic coating forms on the substrate with a predominantly crystalline structure and/or to substantially avoid formation of nanoparticles of the ceramic phase, and/or agglomeration of particles of the ceramic phase, in the plating solution or electrolyte. In these embodiments in which the sol is added to the plating solution at a controlled slow rate during plating, a sol having a sol concentration of 20 to 250 or more preferably 25 to 150 grams of the ceramic phase per liter of the sol may be added to the plating solution at a rate of 30 to 250 or more preferably 100 to 150 mls of sol per liter of the plating solution, and the sol may be added at a rate in the range 0.001 to 0.1 or more preferably 0.005 to 0.02 ails per second.

In other embodiments the sol is added prior to carrying out the plating or coating. The sol is added in a low amount such that nanoparticles of the ceramic phase form directly onto or at the substrate and/or that the metal-ceramic coating forms on the substrate with a predominantly crystalline structure and/or to substantially avoid formation of nanoparticles of the ceramic phase, and/or agglomeration of particles of the ceramic phase, in the plating solution or electrolyte. In these embodiments in which the sol is added to the plating solution prior to plating, a sol having a sol concentration of 20 to 250 or more preferably 25 to 150 grams of the ceramic phase per liter of the sol may be added to the plating solution in a ratio of 0.5 to 100 or more preferably 1.25 to 25 mils of sol per liter of the plating solution.

In other embodiments sol may be added both prior to and during the plating or coating. In certain embodiments the ceramic phase is a single or mixed oxide, carbide, nitride, silicate, boride of Ti, W, Si, Zr, Al, Y, Cr, Fe, Pb, Co, or a rare earth element.

In certain embodiments the coating, other than the ceramic phase comprises Ni, Ni—P, Ni—W—P, Ni—Cu—P, Ni—B, Cu, Ag, Au, Pd.

In certain embodiments the substrate is a metal substrate such as a mild steel, alloy steel, Mg, Al, Zn, Sn, Cu, Ti, Ni, Co, Mo, Pb or an alloy. In other embodiments the substrate is a non-metallic substrate such as a plastics or ceramic substrate.

The term 'sol' in this specification means a solution of the ceramic phase. It is believed that molecules of the ceramic phase such as molecules of $TiO_2$ exist in a net-structure in the sol, and during the plating process react at the surface with to form a crystalline metal—ceramic composite coating.

The plating process may be an electroless plating or coating process or alternatively be a galvanic plating process. Where the plating process is a galvanic plating process the plating current may be in the range 10 $mA/cm^2$ to 300 $mA/cm^2$ preferably 20 $mA/cm^2$ to 100 $mA/cm^2$.

In this specification plating and coating are used interchangeably.

In another aspect the invention comprises an item or surface plated or coated by a process as described above.

The term "comprising" as used in this specification means "consisting at least in part of". When interpreting each statement in this specification that includes the term "comprising", features other than that or those prefaced by the term may also be present. Related terms such as "comprise" and "comprises" are to be interpreted in the same manner.

BRIEF DESCRIPTION OF THE FIGURES

In the subsequent description the following figures are referred to, in which.

DETAILED DESCRIPTION OF EMBODIMENTS

Figure 1:
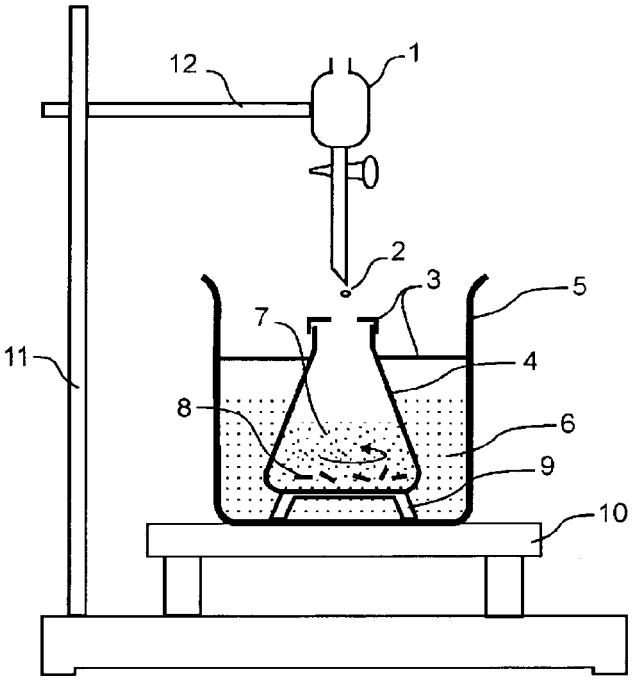
FIG. 1 is a schematic diagram of apparatus used in the experimental work subsequently described in some examples.

The invention comprises a method for producing a metal-ceramic composite coating on a substrate which includes adding a sol of a ceramic phase to the plating solution or electrolyte.

The sol may have a concentration such that the sol is transparent (particles of the ceramic phase are not visibly present in the sol), and may in certain embodiments have a concentration of the ceramic phase of between about 10 to about 200 g/liter, or about 20 to about 100 g/liter.

Where the sol of the ceramic phase is added to the solution or electrolyte during the plating process it may be added throughout the plating or coating process, or in certain embodiments for less than all of the duration of the plating process but at least 80% or at least 70% or at least 60% or at least 50% of the duration of the plating process. Optionally an amount of the sol may also be added to the solution or electrolyte prior to the commencement of plating or coating.

In certain embodiments the sol may be added at a rate of less than about 0.02 ml/liter of the plating solution or electrolyte, and may be added at a rate of less than about 0.01 ml/liter, and preferably less than about 0.07 ml/liter, and in the range about 0.001 to about 0.005 ml/liter. The sol may be added to the plating solution at the required slow rate by dripping or spraying the sol into the plating solution or by any other technique by which the sol can be added at the required slow rate.

It is believed in relation to some embodiments that if the ceramic phase is added as a sol during plating and at a sufficiently slow rate and low concentration, molecules of the ceramic phase from the sol form nanoparticles in situ on or at the surface of the substrate, and that a metal-ceramic composite coating having a largely crystalline rather than an amorphous structure is formed.

In certain embodiments the ceramic phase is a single or mixed oxide, carbide, nitride, silicate, boride of Ti, W, Si, Zr, Al, Y, Cr, Fe, Pb, Co, or a rare earth element.

In certain embodiments the substrate is a metal substrate such as mild steel, alloy steel, Mg, Al, Zn, Sn, Cu, Ti, Ni, Co, Mo, Pb or an alloy. In other embodiments the substrate is a non-metallic substrate such as a plastics and ceramic substrate.

The plating or coating may be carried out to provide improved abrasion or wear resistance or corrosion resistance to an item or surface, to provide an electrically conductive coating on a surface or item, or to alter optical properties, for decorative purposes, for example.

By the process of the invention we have been able to achieve Ni—P—$TiO_2$ coatings having microhardness of about 1025 HV. In a conventional electroplating process in which $TiO_2$ nanoparticles are added to the plating solution before the commencement of the plating and not in a sol, hardness of the order of 670-800 HV is typically achieved.

In another particular embodiment where the substrate is mild carbon steel, the substrate plated or coated by the process of the invention has very low light reflection i.e. is ultra-black.

The plating process may be an electroless plating or coating process, in which the anode comprises the plating metal, the cathode the item to be plated or coated, and the ceramic phase is added as a sol to the solution comprising a reducing agent such as sodium hypophosphite, sodium borohydride, formaldehyde, dextrose, rochelle salts, glyoxal, hydrazine sulfate.

The plating process may alternatively be a galvanic plating process in which the anode comprises the plating metal, or ions of the plating metal are provided in the electrolyte, the cathode comprises the item to be plated, and the ceramic phase is added to the electrolyte as a sol.

EXAMPLES

The following description of experimental work further illustrates the invention by way of example:

Example 1

Ni—P—$TiO_2$ Composite Coating on Mg Alloy by Electroless Plating, at Different Sol Rates A transparent $TiO_2$ sol was prepared in the following way: 8.68 ml of titanium butoxide (0.04 g/ml) was dissolved in a mixture solution of 35 ml of ethanol and 2.82 ml diethanolamine. After magnetic stirring for 2 hours, the obtained solution was hydrolyzed by the addition of a mixture of 0.45 ml deionized water and 4.5 ml ethanol dropwise under magnetic stirring. After stirring for 2 hours, the $TiO_2$ sol was kept in a brown glass bottle to age for 24 hours at room temperature.

The transparent $TiO_2$ sol was added into 150 ml of a conventional Ni—P electroless plating (EP) solution by dripping at a controlled rate during plating (1 drop=0.002 ml approx). During plating the solution was continuously stirred by magnetic stirring at the speed of ~200 r/min. The solution temperature was kept at 80-90° C. and the plating time was ~90 min FIG. 1 shows the experimental apparatus used. In FIG. 1*the* following reference numerals indicate the following parts:

1. Separatory funnel
2. $TiO_2$ sol outlet
3. Lids
4. Erlenmeyer
5. Beaker
6. Water
7. Electroless plating solution
8. Samples
9. Bracket
10. Magnetic stirrer
11. Siderocradle
12. Funnel stand The plating process was repeated at different sol dripping rates and sol concentrations.

On analysis the coatings were found to be mainly crystalline, and to have micro-hardness up to 1025 $HV_{0.2}$, compared to ~590 $HV_{0.2}$ for conventional Ni—P coatings and ~700 $HV_{0.2}$ for conventional Ni—P—$TiO_2$ composite coatings. The width of the wear tracks of the coating was reduced to about 160 μm in some cases, compared to the corresponding width for the conventional composite coating of about 500 μm.

Figure 2:
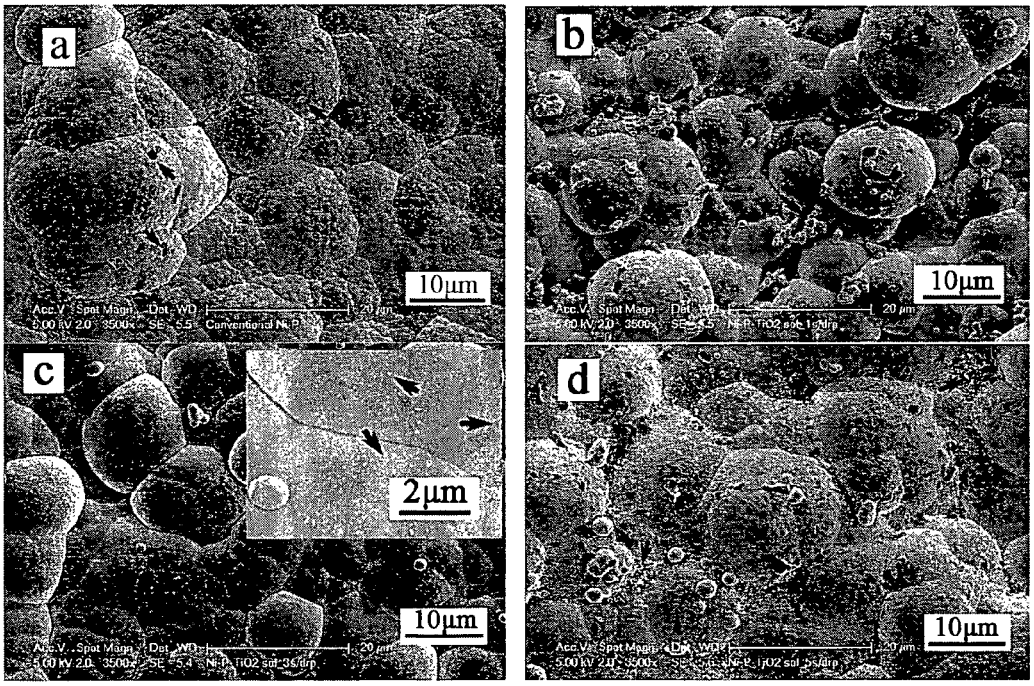
FIG. 2 shows surface morphologies of (a) a conventional Ni—P coating, and novel Ni—P—$TiO_2$ composite coatings prepared at $TiO_2$ sol dripping rates of (b) 0.02 ml/s, (c) 0.007 ml/s and (d) 0.004 ml/s.

FIG. 2 shows surface morphologies of the Ni—P—$TiO_2$ composite coatings produced at sol dripping rates of 0.004, 0.007, 0.02 ml/s, at a concentration of $TiO_2$ sol 120 ml/L.

Referring to FIG. 2*a* the conventional EP Ni—P coating has a typical "cauliflower-like" structure with some pores caused by formation of $H_2$ in the EP process as shown by the arrows.

With $TiO_2$ sol dripped into the EP Ni—P solution at a rate of 0.02 ml/s, the "cauliflower" structure became smaller—see FIG. 2*b* Clusters of micro-Ni crystals formed in the interfaces, indicating that the $TiO_2$ sol addition promoted the nucleation of Ni crystals and prevented the growth of Ni crystals.

FIG. 2*c* shows the coating produced at a sol dripping rate of 0.007 ml/s. It was compact and smooth coating of FIG. 2*a*. Well-dispersed white nano-particles were distributed on the surface as shown by the arrows on the right top inset in FIG. 2*c*. It is believed that these particles are $TiO_2$ nanoparticles.

At a $TiO_2$ sol dripping rate of 0.004 ml/s, the coating was also compact and smooth—see FIG. 2*d*. Loose $TiO_2$ particles congregated in the interfaces between Ni crystals as shown by the arrows in the FIG. 2*d*.

Figure 3:
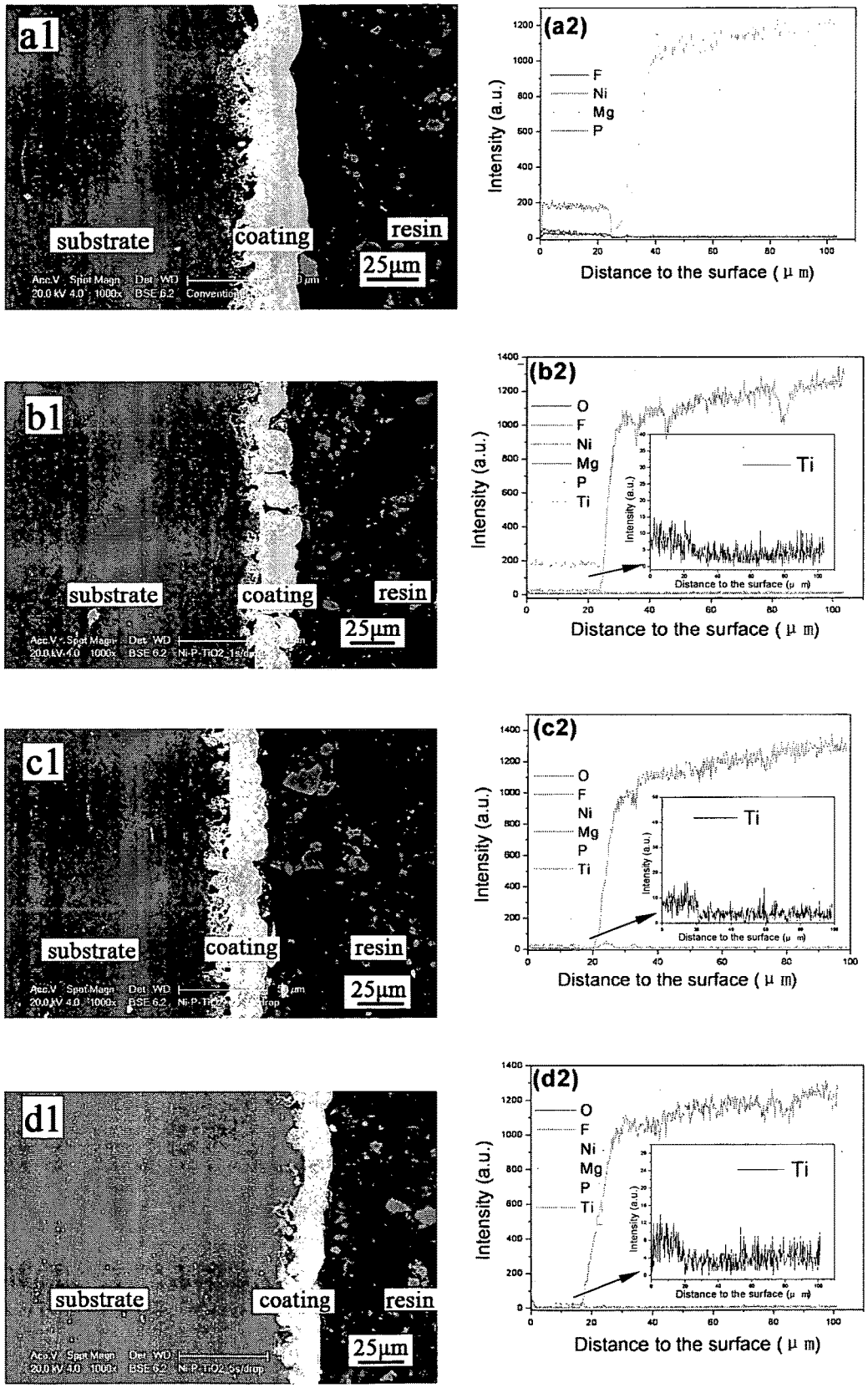
FIG. 3 shows cross-sectional morphologies and elemental distributions of (a1, a2) a conventional Ni—P coating, and novel Ni—P—$TiO_2$ composite coatings prepared at $TiO_2$ sol dripping rates of (b1, b2) 0.02 ml/s, (c1, c2) 0.007 ml/s, and (d1, d2) 0.004 ml/s.

FIG. 3 shows cross-sectional morphologies and elemental distributions of an Ni—P coating, and of Ni—P—$TiO_2$ composite coatings prepared at the different dripping rates of $TiO_2$ sol.

The conventional Ni—P coating is compact with a thickness of ~25 μm—see FIG. 3*a*1, and good adhesion to the Mg substrate. The Ni and P elements have homogeneous distributions along the coating—see FIG. 3*a*2.

FIGS. 3*b*1 and 3*b*2 show the microstructure and elemental distributions of the Ni—P—$TiO_2$ composite coating prepared with a sol dripping rate of 0.02 ml/s. The coating was thinner than the Ni—P coating. The thickness further decreased, from about 23 μm to around 20 μm at a sol dripping rate of 0.007 ml/s—FIGS. 3*c*1 and 3*c*1, and to 18 μm at a dripping rate of 0.004 ml/s—see FIG. 3*d*1.

Figure 4:
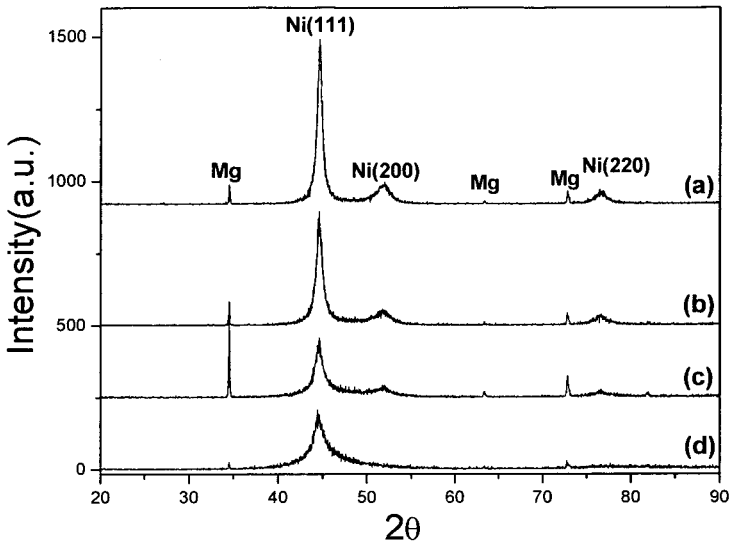
FIG. 4 shows XRD spectra of Ni—P—$TiO_2$ composite coatings prepared at different sol dripping rates of (a) 0.004 ml/s, (b) 0.007 ml/s and (c) 0.02 ml/s, and of (d) a conventional Ni—P coating.

FIGS. 4*a-c* show the XRD spectra for the Ni—P—$TiO_2$ composite coatings prepared at the different dripping rates, and FIG. 4*d* for the Ni—P coating. The conventional EP medium P content coating possesses a typical semi-crystalline structure, i.e. mixture of amorphous phase and crystallized phase, while the Ni—P—$TiO_2$ composite coatings possess fully crystalline phase structures.

Figure 5:
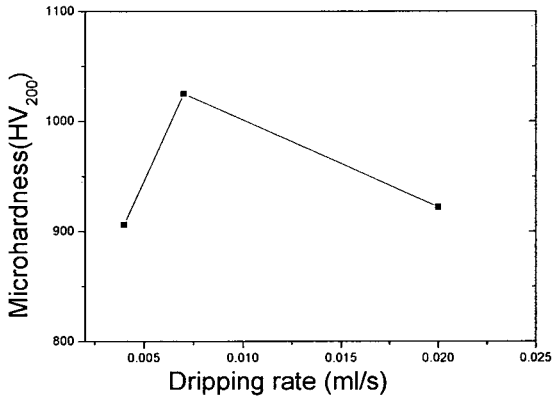
FIG. 5 shows microhardness of Ni—P—$TiO_2$ composite coatings prepared at different sol dripping rates.

The composite coatings produced by the process of the invention possess hardness up to about 1025 $HV_{200}$, compared to about 710 $HV_{200}$ for composite coatings prepared by powder methods and about 570 $HV_{200}$ for conventional Ni—P coatings. FIG. 5 shows the microhardness of the Ni—P—$TiO_2$ composite coatings prepared at sol dripping rates of from 0.004 ml/s to 0.02 ml/s. Greatest hardness was obtained at the dripping rate of 0.007 ml/s.

Figure 6:
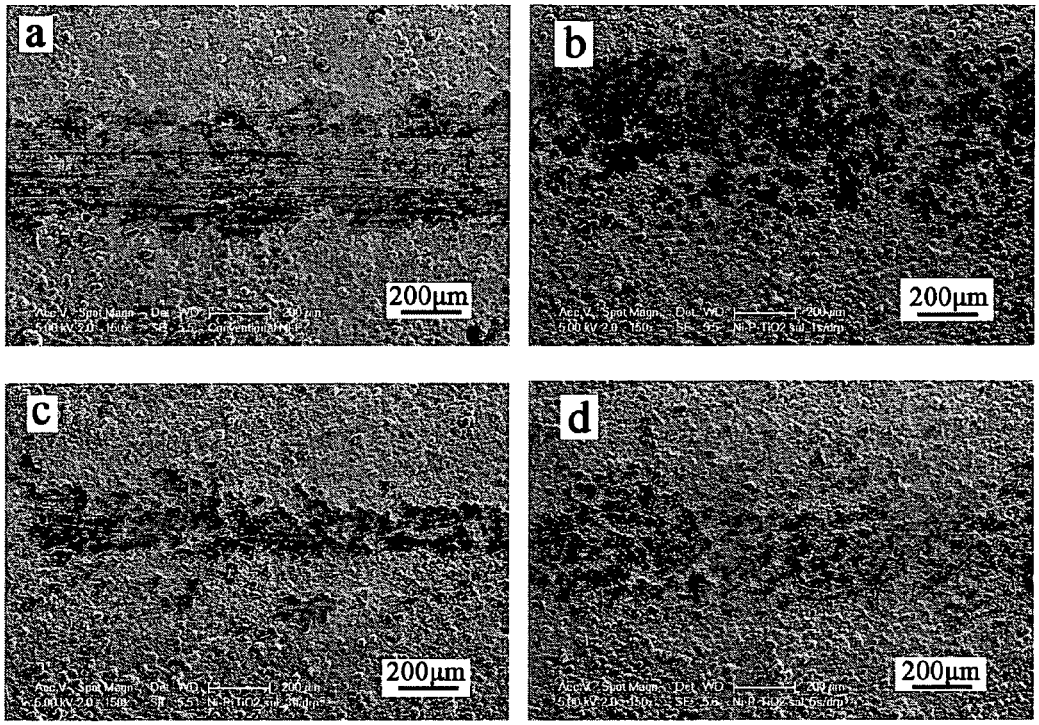
FIG. 6 shows wear track images for (a) a conventional Ni—P coating, and novel Ni—P—$TiO_2$ composite coatings prepared with the $TiO_2$ sol dripping rates of (b) 0.02 ml/s, (c) 0.007 ml/s and (d) 0.004 ml/s.

In FIG. 6*a* the width of wear track of the conventional Ni—P coating was about 440 μm. Many deep plough lines are observed. In contrast, the novel Ni—P—$TiO_2$ composite coatings possessed better wear resistance as seen from FIGS. 6*b, c* and *d*. The wear track of the composite coatings had a narrower width of about 380 μm at 0.02 ml/s, 160 μm at 0.007 ml/s, and 340 μm at 0.004 ml/s. The novel composite coatings also had very few plough lines compared with the conventional Ni—P coatings.

Example 2

Ni—P $TiO_2$ Composite Coatings on Mg by Electroless Plating, at Different Sol Concentrations The effect of $TiO_2$ concentration in the sol was also studied. Ni—P—$TiO_2$ composite coatings were prepared as described in Example 1 but with a constant sol dripping rate of 0.007 ml/s and at sol concentrations of $TiO_2$ sol at 30, 60, 90, 120, 150 and 170 ml/L (1.2, 2.4, 3.6, 4.8, 6.0, 6.8 g/L).

Figure 7:
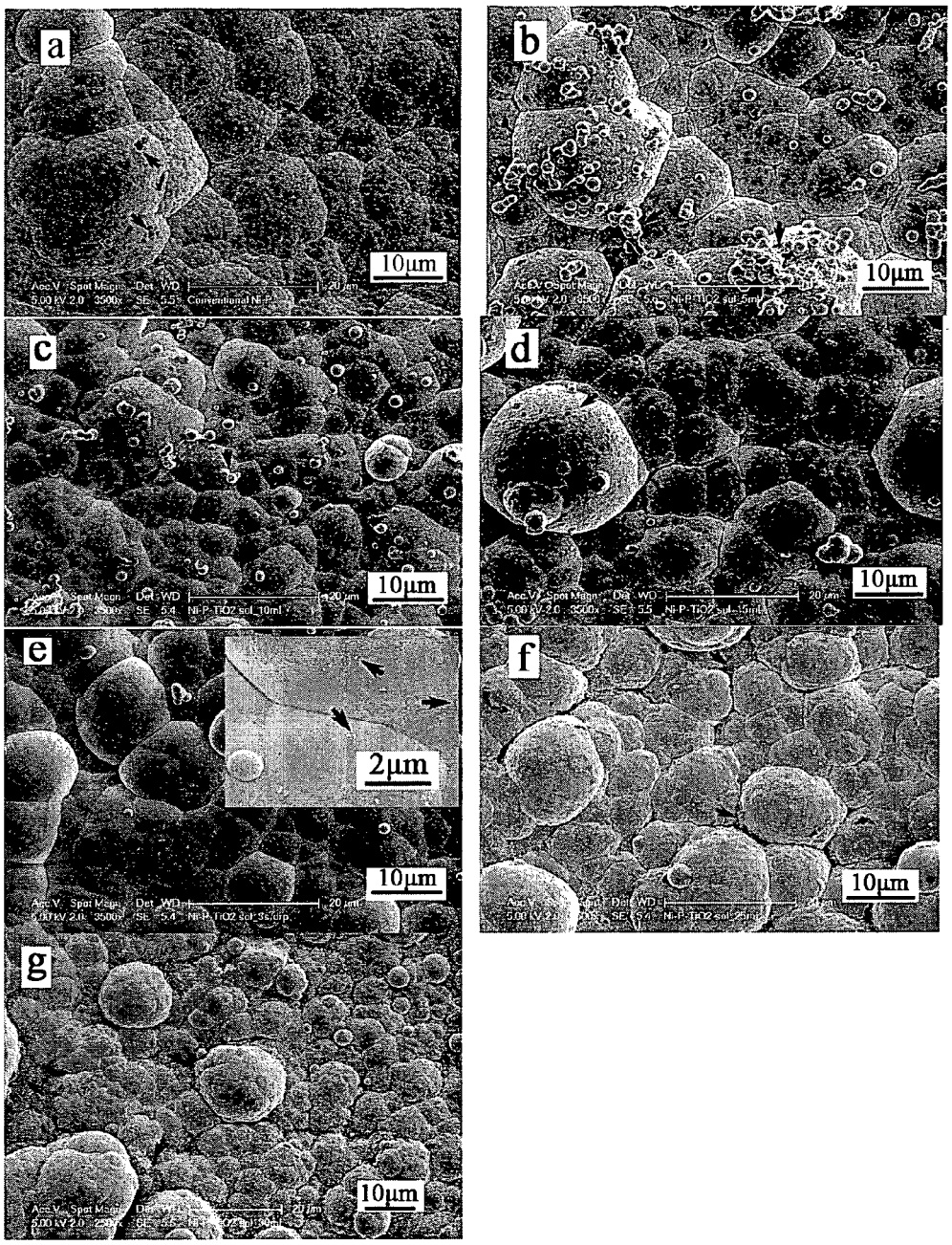
FIG. 7 shows surface morphologies of (a) a conventional Ni—P coating, and novel Ni—P—$TiO_2$ composite coatings prepared at different concentrations of $TiO_2$ sol of (b) 30 ml/L, (c) 60 ml/L, (d) 90 ml/L, (e) 120 ml/L, (f) 150 ml/L, and (g) 170 ml/L.

FIG. 7 shows surface morphologies of a conventional Ni—P coating and the novel Ni—P—$TiO_2$ composite coatings prepared at different $TiO_2$ sol concentrations.

FIG. 7*a* shows the typical "cauliflower"-like structure of the conventional Ni—P coating with some pores on the surface due to the formation of $H_2$ in the EP process as shown by the arrows.

FIGS. 7*b* and 7*c* show the surface morphologies of the composite coatings with $TiO_2$ sol dripped into the EP solution at concentrations of 30 ml/L and 60 ml/L, respectively. No white $TiO_2$ particles were observed in the EP solution during the process. Many micro-sized Ni crystallites formed and congregated on the big Ni grains or in the low-lying interfaces between Ni grains—see FIG. 7*b*. At a sol concentration of 60 ml/L, many well-dispersed and micro-sized Ni crystallites formed on the surface with no congregation—see FIG. 7*c*, and the Ni crystallites became smaller with a smoother surface. White $TiO_2$ particles were formed in the EP solution as the sol concentration increased.

FIG. 7*d* shows the surface morphology of the coating produced at a sol concentration of 90 ml/L. Micro-sized Ni crystallites are smaller with good dispersion. Large-scale Ni crystals were observed with many small and well-dispersed Ni crystallites on them as shown by the arrows in FIG. 7*d*. At a sol concentration of 120 ml/L, micro-sized Ni crystals almost disappeared—see FIG. 7*e*, and nano-sized $TiO_2$ particles were observed on the surface with good dispersion as shown by the arrows in the inset of FIG. 7*e*.

Figure 8:
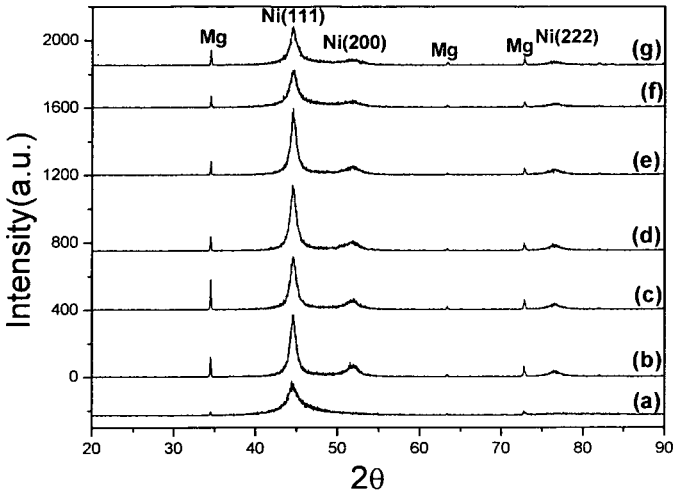
FIG. 8 shows XRD spectra of (a) a conventional Ni—P coating, and novel Ni—P—$TiO_2$ composite coatings prepared at $TiO_2$ sol concentrations of: (b) 30 ml/L, (c) 60 ml/L, (d) 90 ml/L, (e) 120 ml/L, (f) 150 ml/L, and (g) 170 ml/L.

FIG. 8 shows XRD spectra of the conventional Ni—P coating and the novel Ni—P—$TiO_2$ composite coatings at the different concentrations of $TiO_2$ sol. The conventional EP Ni—P coating has a typical semi-crystallized structure, i.e. a mixture of amorphous and crystalline phases—see FIG. 5*a*, while the novel Ni—P—$TiO_2$ composite coatings have different phase structures with better crystallinity at the lower concentrations of $TiO_2$ sol as shown in FIGS. 8*b*, 8*c*, 8*d* and 8*e*. The coatings have a semi-crystalline structure at higher sol concentrations of 150 and 170 ml/L—see FIGS. 8*f* and 8*g*.

Figure 9:
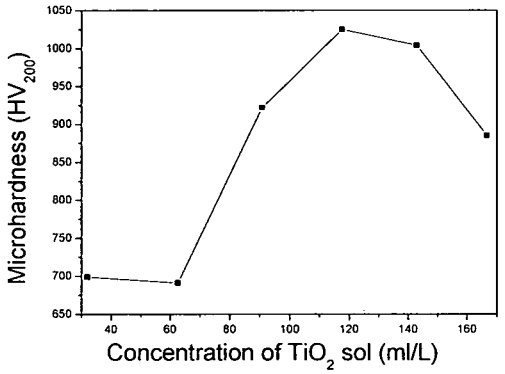
FIG. 9 shows microhardness of the novel Ni—P—$TiO_2$ coatings prepared at different concentrations of $TiO_2$ sol.

The effect of sol concentration on the microhardness of the composite coatings is shown in FIG. 9. At relatively low $TiO_2$ sol concentrations of 30-60 ml/L, the microhardness was about 700 $HV_{200}$. No white $TiO_2$ particles were observed. At sol concentrations of from 60 to 120 ml/L white $TiO_2$ particles were observed in the EP solution, and the microhardness increased to a peak of about 1025 $HV_{200}$.

Figure 10:
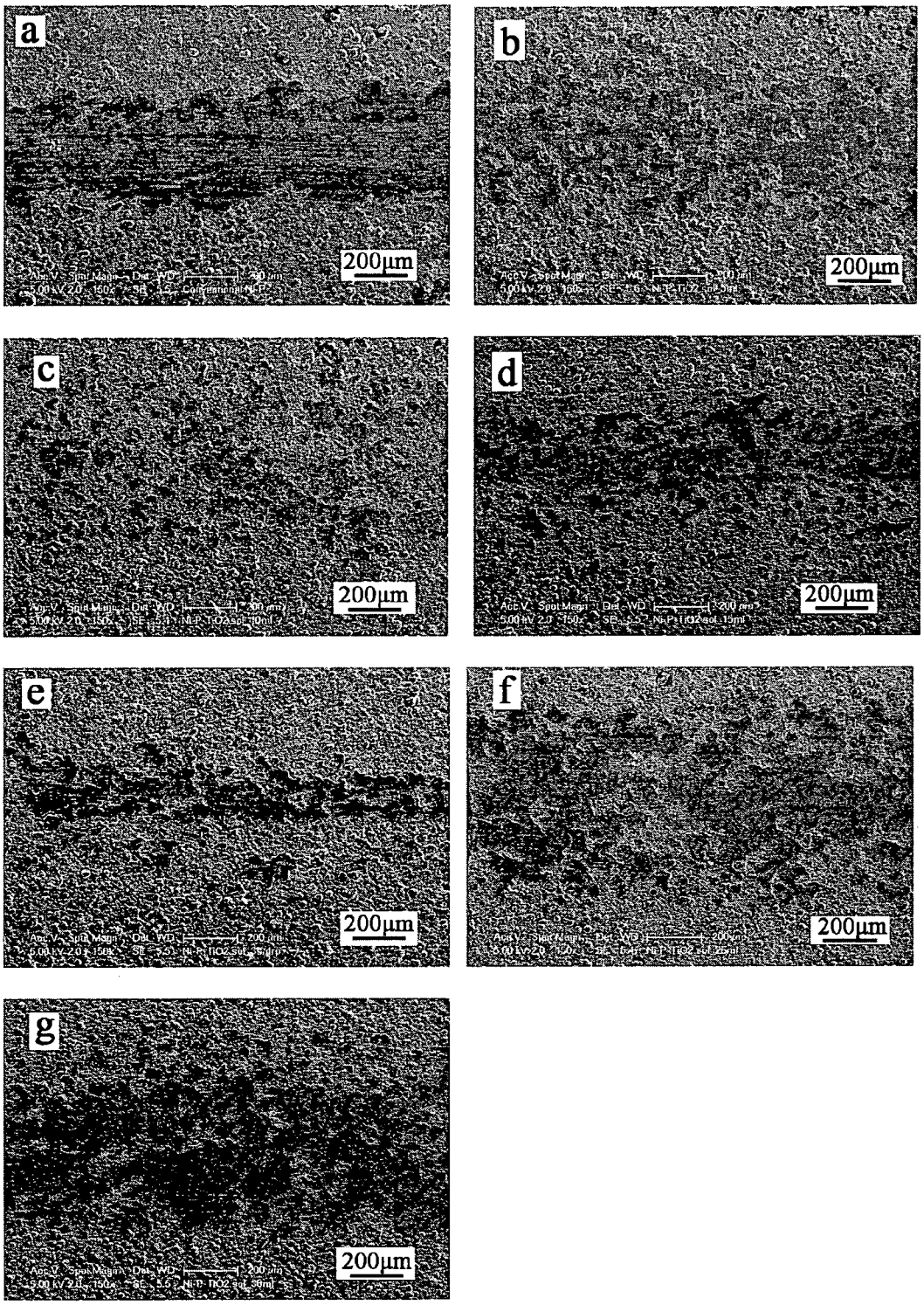
FIG. 10 shows wear tracks of (a) a conventional Ni—P coating, and novel Ni—P—$TiO_2$ coatings prepared at $TiO_2$ sol concentrations of (b) 30 ml/L, (c) 60 ml/L, (d) 90 ml/L, (e) 120 ml/L, (f) 150 ml/L, and (g) 170 ml/L.

Images of wear tracks on the conventional Ni—P coating and the novel Ni—P—$TiO_2$ composite produced at different concentrations of $TiO_2$ sol are shown in FIG. 10.

At sol concentrations of 30-60 ml/L the wear tracks became discontinuous as shown in FIGS. 10*b* and 10*c*, and almost no plough lines are observed. At sol concentrations of 90-120 ml/L the tracks became narrower (but more continuous)—the width of tracks decreased from ~240 μm to ~160 μm. FIGS. 10*d* and 10*e* show the wear tracks on coatings produced at sol concentrations of 150 and 170 ml/L.

We observed that when the sol was dripped into the EP solution it fast diluted under stirring. The solution was kept transparent and no white particles could be seen by the naked eye, implying that the $TiO_2$ particles are very small. The $TiO_2$ nano-particles have no opportunity to agglomerate together to form clusters. Therefore nano-sized $TiO_2$ particles are deposited together with Ni, forming a metal/nano-oxide composite coating. The nano-particle dispersion also contributes to the improved hardness and wear resistance.

Example 3

Ni—$TiO_2$ Coating on Mild Steel by Electroplating, at Different Sol Concentrations A Ni—$TiO_2$ electroplating coating was formed on carbon steel by adding a $TiO_2$ sol prepared as described in example 1 into a traditional Ni electroplating solution at the commencement of electroplating. The bath composition and electroplating parameters are listed in the table below. 12.5 ml/l of transparent $TiO_2$ sol solution prepared as described in example 1 was added to the electroplating solution, and then Ni—$TiO_2$ composite coatings were formed on carbon steels with a current of 50 mA/$cm^2$. Ni and Ni—$TiO_2$ coatings were prepared without sol addition for comparison. The Ni—$TiO_2$ coating was prepared with a concentration of $TiO_2$ nano-particles (diameter<25 nm) of 10 g/L.

| Bath composition/ parameters | Quantity |
|---|---|
| $NiSO_4 \cdot 6H_2O$ | 300 g/L |
| $NiCl_2 \cdot 6H_2O$ | 45 g/L |
| $H_3BO_3$ | 40 g/L |
| $TiO_2$ sol | 12.5 mL/L |
| pH | 3.8 |
| Temperature | Room temperature (20° C.) |
| Current i | 50 mA/cm$^2$ |
| Time | 10 min |

The Ni—$TiO_2$ composite coating formed had a micro-hardness of 428 $HV_{100}$, compared to 356 $HV_{100}$ for the Ni—$TiO_2$ composite coating formed conventionally and 321 $HV_{100}$ for the Ni coating.

Coatings were prepared at $TiO_2$ sol concentrations of 0, 1.25, 2.5, 7.5, 12.5 and 50 ml/L (0, 0.05, 0.0625, 0.3, 0.5, 2 g/L).

Figure 11:
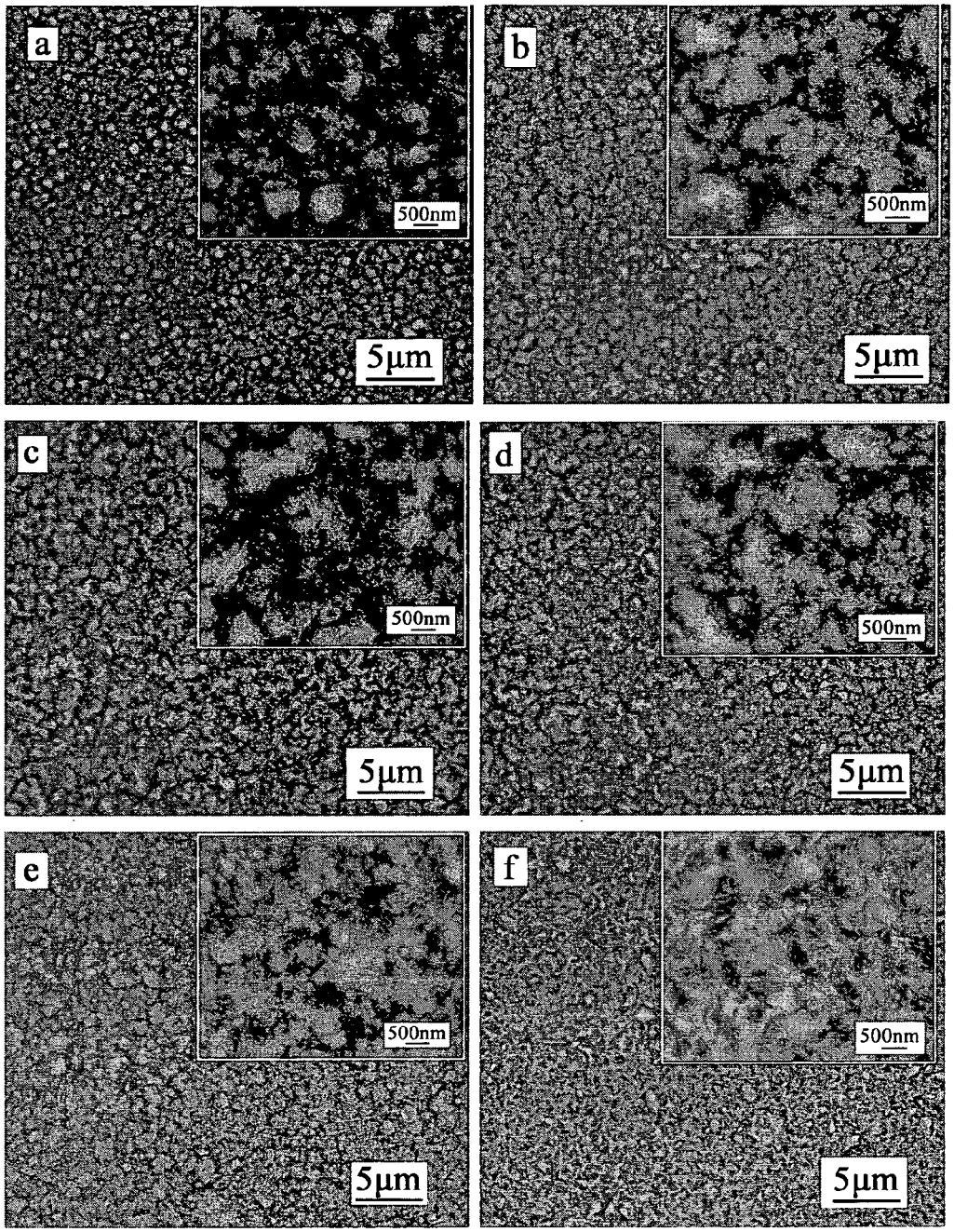
FIG. 11 shows surface morphologies of (a) a conventional electroplating Ni coating, and Ni—$TiO_2$ composite coatings prepared at different concentrations of $TiO_2$ sol: (b) 1.25 ml/L, (c) 2.5 ml/L, (d) 7.5 ml/L, (e) 12.5 ml/L, (f) 50 ml/L.

FIG. 11 shows surface morphologies of the Ni—$TiO_2$ composite coatings prepared at sol concentrations of 0, 1.25, 2.5, 7.5, 12.5 and 50 ml/L.

Figure 12:
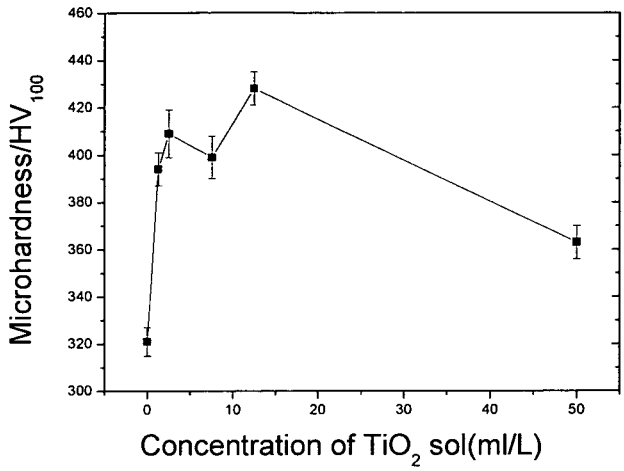
FIG. 12 shows micro-hardness results of Ni—$TiO_2$ composite coatings prepared at different concentrations of $TiO_2$ sol.

FIG. 12 shows microhardness of the Ni—$TiO_2$ composite coatings prepared at sol concentrations of 0, 1.25, 2.5, 7.5, 12.5 and 50 ml/L. The microhardness of the Ni coating was nearly 320 $HV_{100}$. The Ni—$TiO_2$ composite coatings had increased microhardness, up to 428 $HV_{100}$, at the sol concentrations of 1.25 ml/L to 12.5 ml/L.

Figure 13:
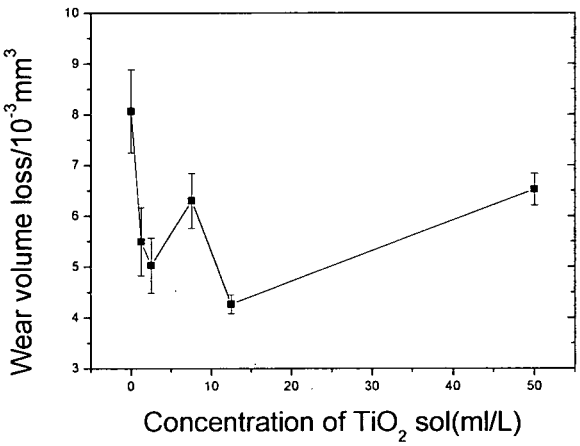
FIG. 13 shows wear volume loss of Ni—$TiO_2$ composite coatings prepared at different concentrations of $TiO_2$ sol.

Referring to FIG. 13 the Ni coating had the worst wear volume loss at about $8\times10^{-3}$ mm$^3$. The Ni—$TiO_2$ composite coatings had better wear resistance.

Example 4

Ni—$TiO_2$ Coating on Mild Steel by Electroplating, at Different Currents

Figure 14:
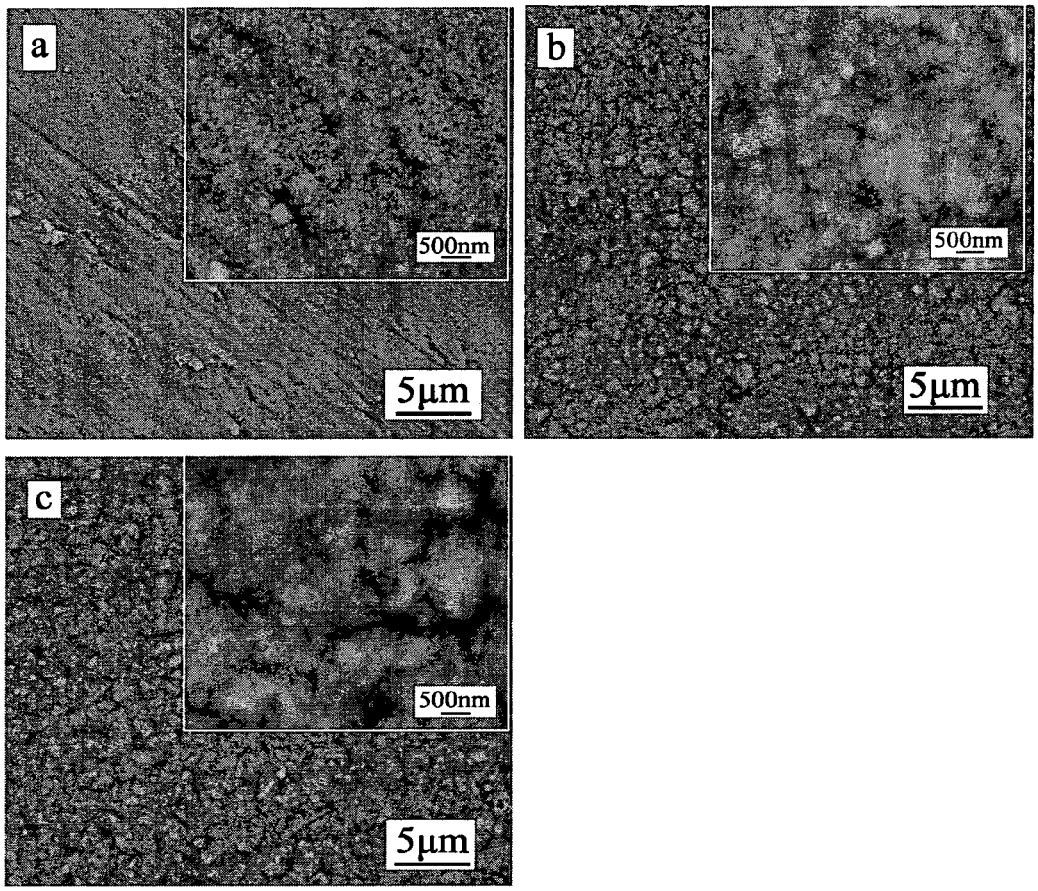
FIG. 14 shows the surface morphologies of Ni—$TiO_2$ composite coatings prepared at different plating currents: (a) 10 mA/cm$^2$, (a) 50 mA/cm$^2$, (a) 100 mA/cm$^2$.

Coatings were prepared as in Example 3 but at different plating currents. FIG. 14 shows the surface morphologies of Ni—$TiO_2$ composite coatings prepared with 12.5 ml/L $TiO_2$ sol addition at currents of 10, 50, 100 mA/cm$^2$.

Figure 15:
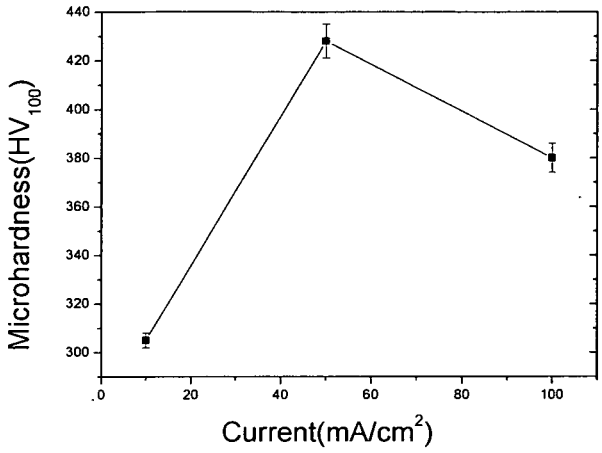
FIG. 15 shows micro-hardness results of Ni—$TiO_2$ composite coatings prepared at different plating currents.

FIG. 15 shows the microhardness of Ni—$TiO_2$ composite coatings prepared with 12.5 ml/L $TiO_2$ sol addition at currents of 10, 50, 100 mA/cm$^2$. At 10 mA/cm$^2$ the coating had a microhardness of about 300 $HV_{100}$, the microhardness increased to 428 $HV_{100}$ at 50 mA/cm$^2$, and the microhardness was about 380 $HV_{100}$ at current of 100 mA/cm$^2$.

Figure 16:
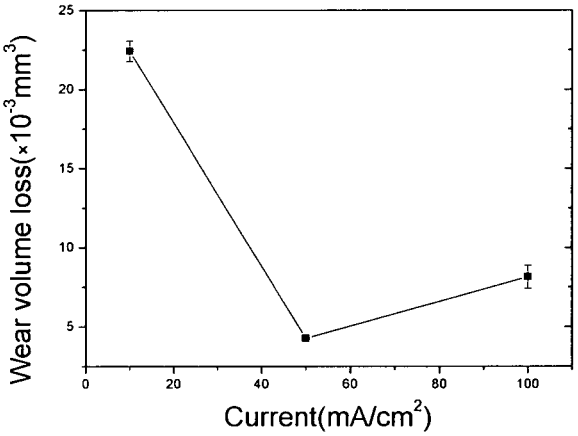
FIG. 16 shows wear volume loss of Ni—$TiO_2$ composite coatings prepared at different currents.

FIG. 16 shows wear volume loss of the Ni—$TiO_2$ composite coatings. The coating had best wear resistance at 50 mA/cm$^2$, with a wear volume loss of about 0.004 mm$^3$.

Example 5

Ultra-Black Ni—P—$TiO_2$ Composite Coating on Carbon Steel, by Electroless Plating An Ni—P—$TiO_2$ electroless coating with ultra-black surface was formed on carbon steel through adding $TiO_2$ sol prepared as in example 1 into a conventional Ni electroless solution at a controlled rate. When 90 ml/L (3.6 g/L) transparent $TiO_2$ solution was added at a rate of 0.007 ml/s to a plating solution of 150 ml, a Ni—P—$TiO_2$ electroless coating with an ultra-black surface with the lowest reflectance at 0.1-0.5% of visible light was formed.

Figure 17:
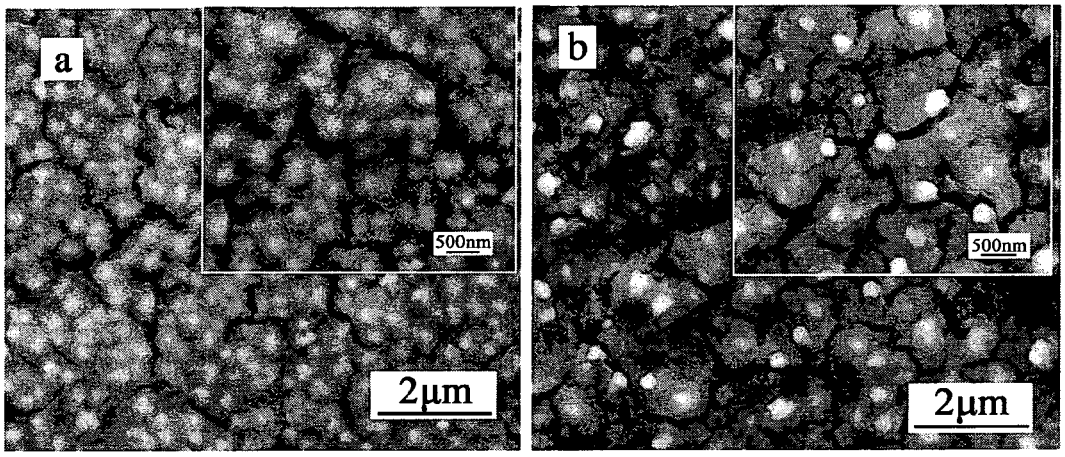
FIG. 17 shows the surface morphologies of ultra-black surfaces of Ni—P—$TiO_2$ composite coatings prepared with dripping rates of $TiO_2$ sol of (a) 0.007 ml/s and (b) 0.004 ml/s.

FIG. 17 shows the surface morphologies of Ni—P—$TiO_2$ composite coatings prepared at different sol addition rates of 0.007 and 0.004 ml/s.

Figure 18:
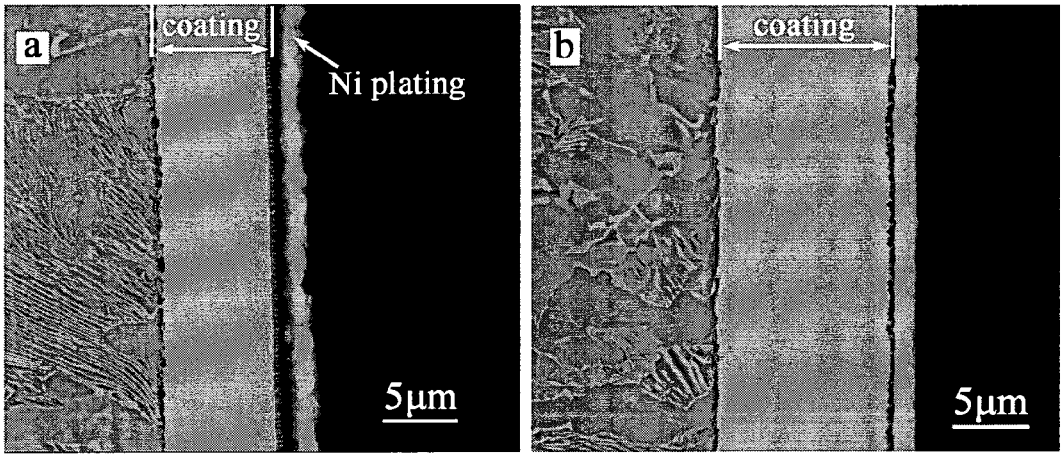
FIG. 18 shows the cross-sectional morphologies of ultra-black surfaces of Ni—P—$TiO_2$ composite coatings prepared with dripping rates of $TiO_2$ sol of (a) 0.007 ml/s and (b) 0.004 ml/s.

FIG. 18 shows the cross-sectional morphologies of Ni—P—$TiO_2$ composite coatings prepared at different sol addition rates.

Figure 19:
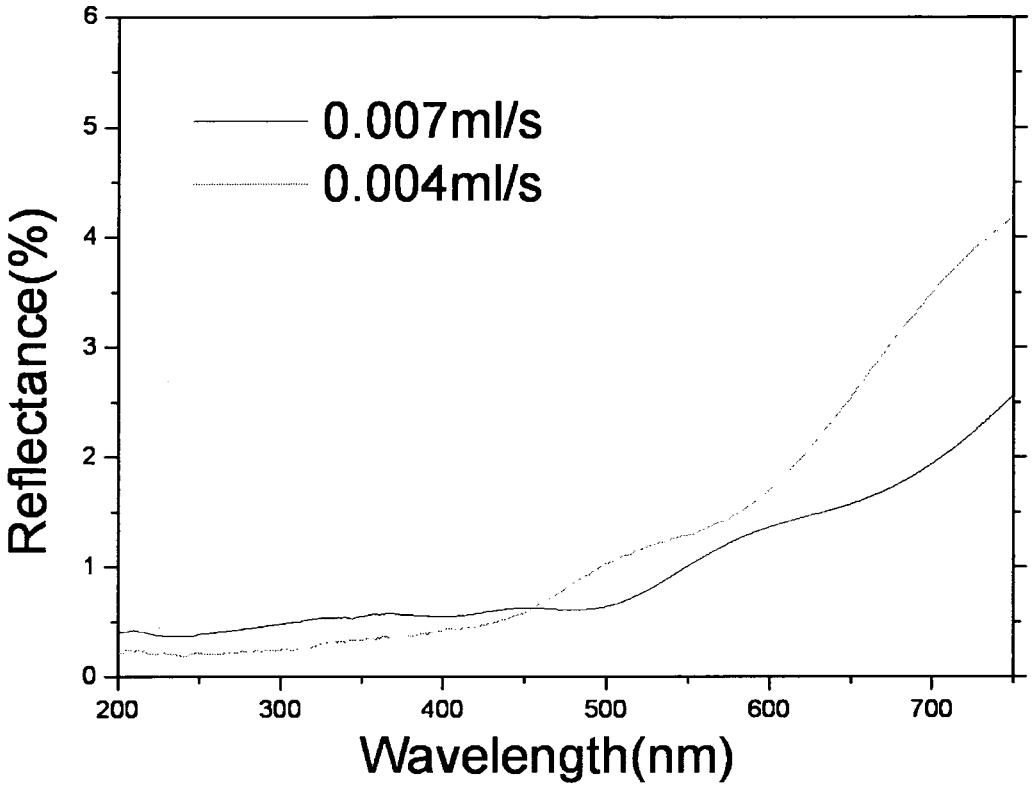
FIG. 19 shows the reflectance of ultra-black surfaces of Ni—P—$TiO_2$ composite coatings prepared with dripping rates of $TiO_2$ sol of 0.007 and 0.004 ml/s.

FIG. 19 shows the reflectance of the ultra-black surfaces of Ni—P—$TiO_2$ composite coatings prepared at different sol addition rates, in the range of visible light. Lower reflectance was obtained when the $TiO_2$ sol was added at 0.007 ml/s.

Figure 20:
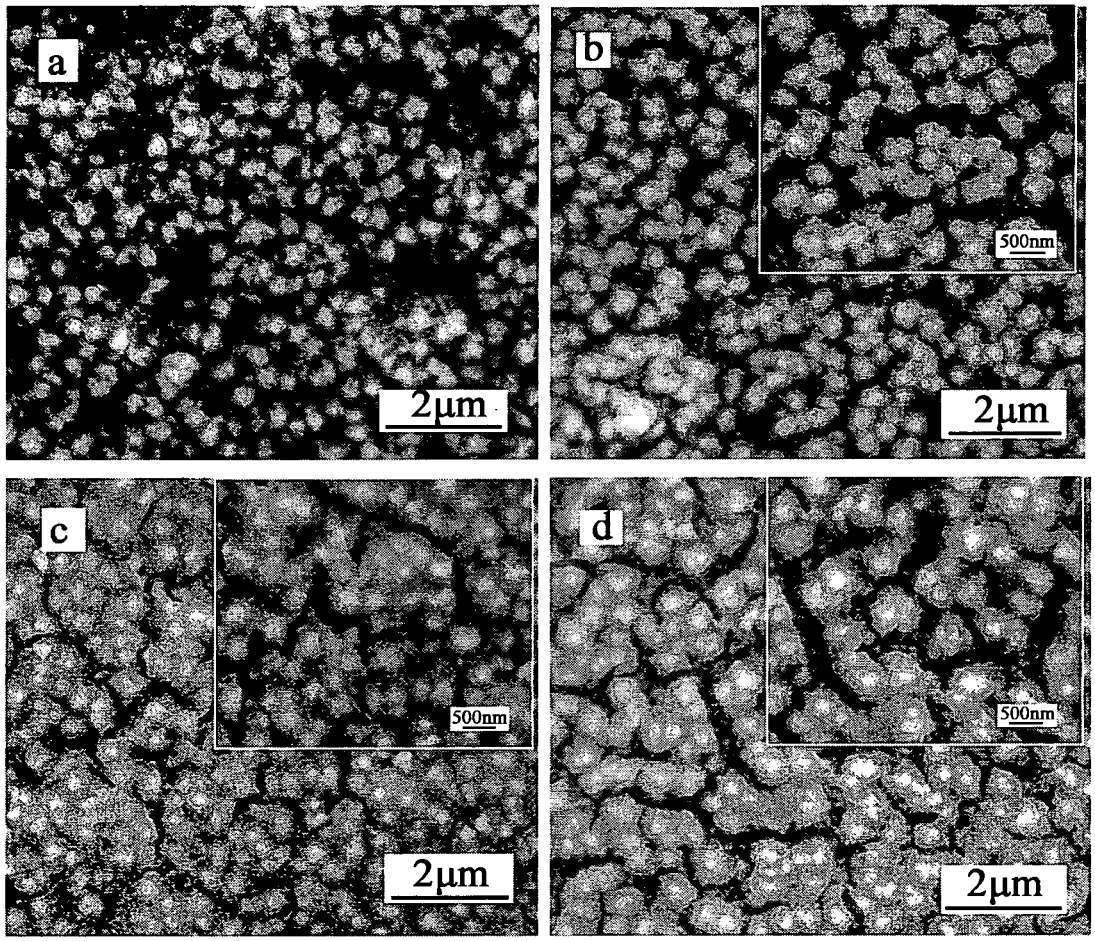
FIG. 20 shows the surface morphologies of ultra-black surfaces of Ni—P—$TiO_2$ composite coatings prepared with concentrations of $TiO_2$ sol at (a) 50 ml/L, (b) 90 ml/L, (c) 120 ml/L and (b) 150 ml/L.

FIG. 20 shows the surface morphologies of Ni—P—$TiO_2$ composite coatings prepared at different sol concentrations of 50, 90, 120 and 150 ml/L.

Figure 21:
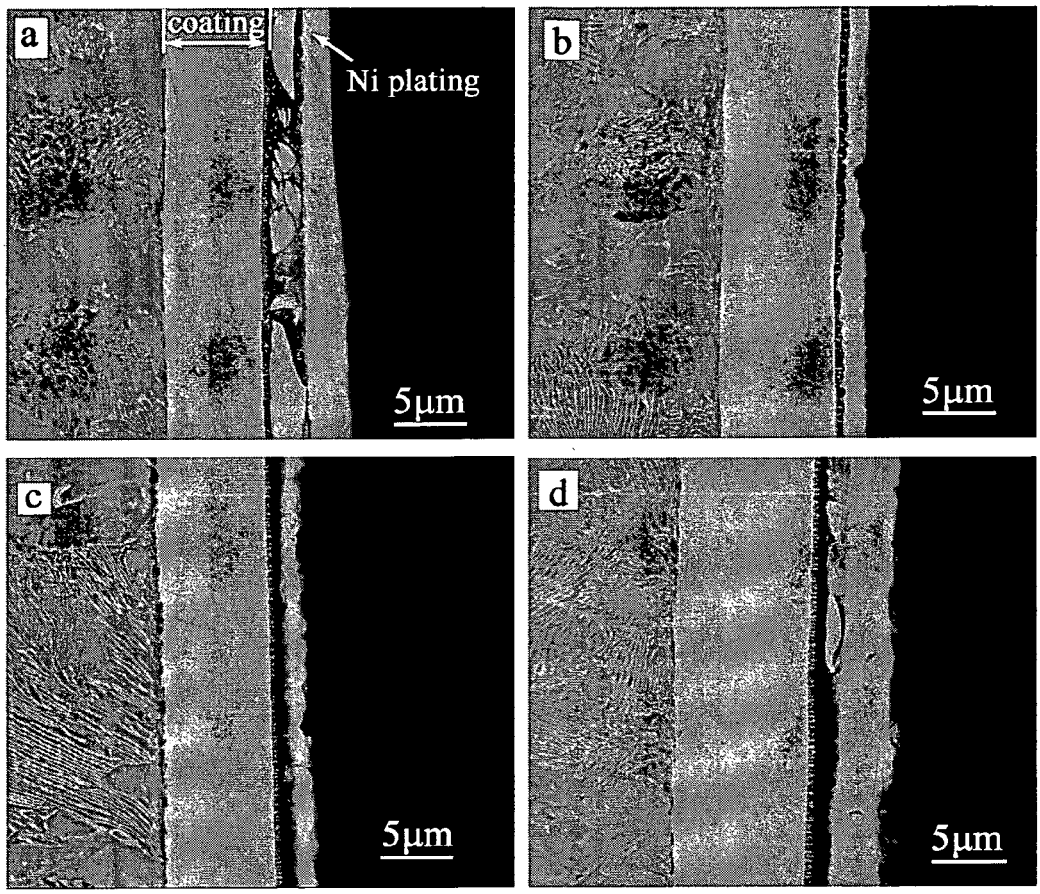
FIG. 21 shows the cross-sectional morphologies of ultra-black surfaces of Ni—P—$TiO_2$ composite coatings prepared with concentrations of $TiO_2$ sol at (a) 50 ml/L, (b) 90 ml/L, (c) 120 ml/L and (b) 150 ml/L.

FIG. 21 shows the cross-sectional morphologies of Ni—P—$TiO_2$ composite coatings prepared at different sol concentrations.

Figure 22:
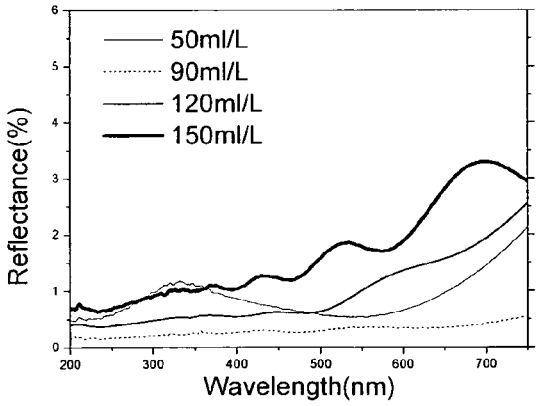
FIG. 22 shows the reflectance of ultra-black surfaces of Ni—P—$TiO_2$ composite coatings prepared with concentrations of $TiO_2$ sol at 50, 90, 120 and 150 ml/L.

FIG. 22 shows the reflectance of ultra-black surfaces of Ni—P—$TiO_2$ composite coatings in the range of visible light prepared at different sol concentrations.

Example 6

Cu—$TiO_2$ Coatings on Carbon Steel, by Electroplating

A small amount of $TiO_2$ sol prepared as in example 1 was added into a conventional electroplating Cu solution, leading to the in situ synthesis of Cu—$TiO_2$ composite coatings. This novel Cu—$TiO_2$ composite coating had a micro-hardness of 210 HV, compared to 150 HV of the traditional Cu coating, showing 40% increase.

Example 7

Ni—P—$ZrO_2$ Composite Coating on Mg Alloy, by Electroless Plating

A transparent $ZrO_2$ sol was prepared in the following way: 45 ml of zirconium propoxide was dissolved in a mixture solution of 124 ml of ethanol and 11.3 ml diethanolamine. After magnetic stirring for 2 hours, the obtained solution was hydrolyzed by the addition of a mixture of 1.84 ml deionized water and 16.2 ml ethanol dropwise under magnetic stirring. After stirring for 2 hours, the $ZrO_2$ sol was kept in a brown glass bottle to age for 24 hours at room temperature. The transparent $ZrO_2$ sol was added into a conventional Ni—P electroless plating (EP) solution by dripping at a controlled rate during plating (1 drop=0.002 ml approx). During plating the solution was continuously stirred by magnetic stirring at the speed of ~200 r/min. The solution temperature was kept at 80-90° C. and the plating time was ~90 min.

Figure 23:
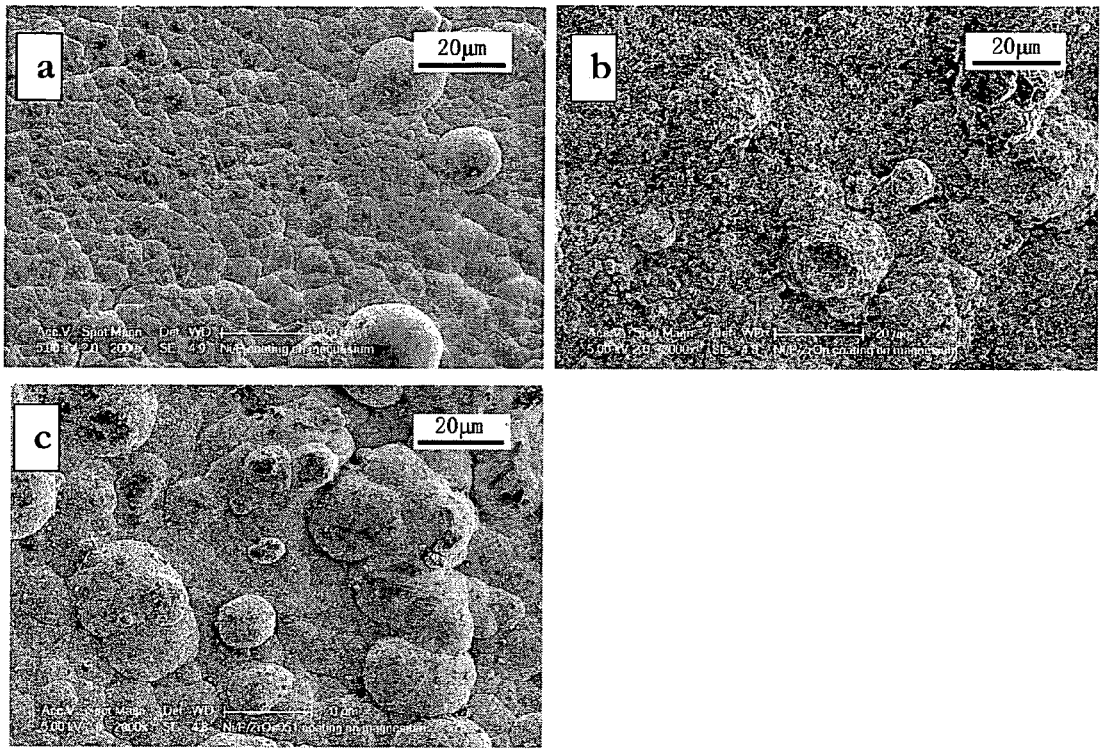
FIG. 23 shows the surface morphologies of (a) a conventional electroless plated Ni—P coating, (b) a conventional Ni—P—$ZrO_2$ composite coating, and (c) a novel Ni—P—$ZrO_2$ composite coating with the sol concentration of 120 ml/L.

FIG. 23 shows surface morphologies of the Ni—P—$ZrO_2$ composite coatings produced at sol dripping rates of 0.007 ml/s, at a concentration of $ZrO_2$ sol 120 ml/L.

Figure 24:
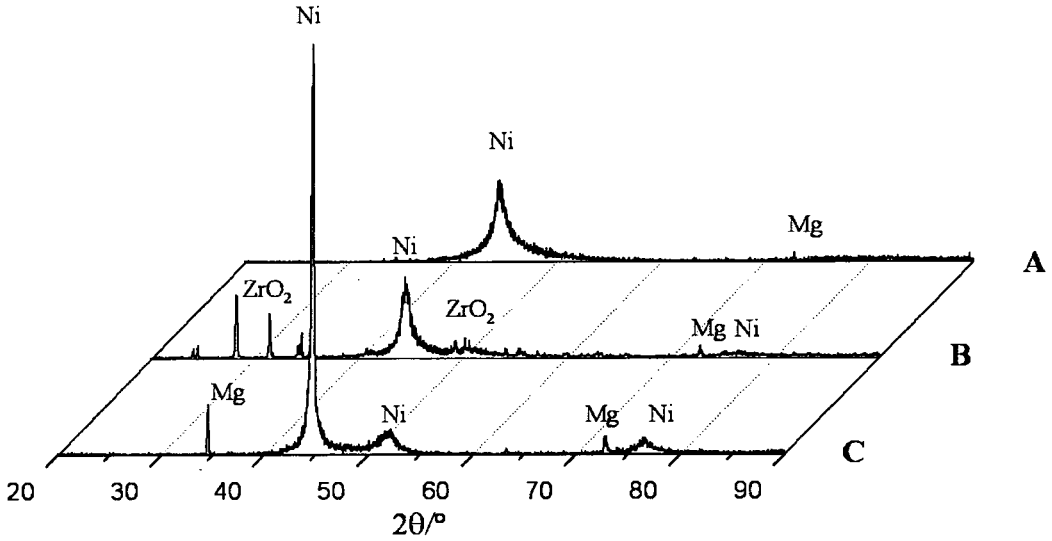
FIG. 24 shows the XRD spectra of (a) a conventional electroless plated Ni—P coating, (b) a conventional Ni—P—$ZrO_2$ composite coating, and (c) a novel Ni—P—$ZrO_2$ composite coating with the sol concentration of 120 ml/L.

FIG. 24 show the XRD spectra of the Ni—P—$ZrO_2$ composite coatings produced at sol dripping rates of 0.007 ml/s, at a concentration of $ZrO_2$ sol 120 ml/L.

The traditional electroless plated Ni—P and Ni—P—$ZrO_2$ coatings possessed a typical semi-crystallization, i.e. the mixture of crystallization and amorphous state, as shown in FIG. 24 a and b. In contrast, the Ni—P—$ZrO_2$ composite coating had a fully crystallized state as shown in FIG. 24*c*.

Figure 25:
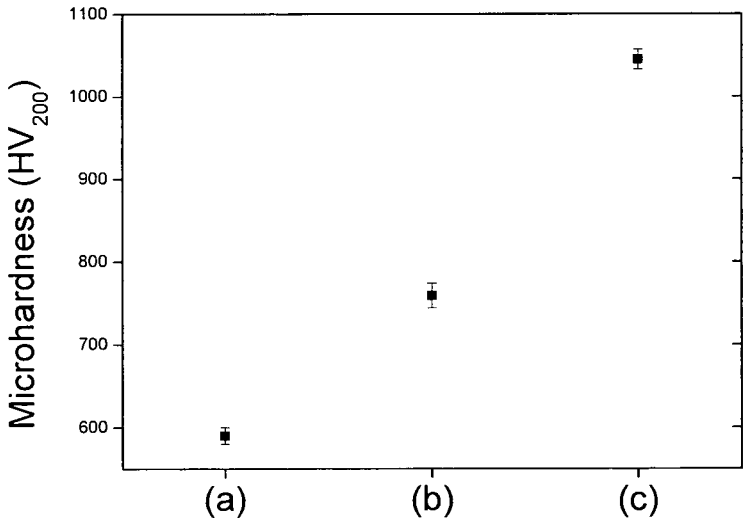
FIG. 25 shows the microhardness of (a) a conventional electroless plated Ni—P coating, (b) a conventional Ni—P—$ZrO_2$ composite coating, and (c) a novel Ni—P—$ZrO_2$ composite coating with the sol concentration of 120 ml/L.

FIG. 25 shows the mechanical properties of the Ni—P—$ZrO_2$ composite coatings produced at sol dripping rates of 0.007 ml/s, at a concentration of $ZrO_2$ sol 120 ml/L.

The microhardness of the Ni—P—ZrO2 composite coating was increased to 1045 $HV_{200}$ compared to 590 $HV_{200}$ of the conventional Ni—P coating and 759 $HV_{200}$ of the conventional Ni—P—$ZrO_2$ composite coating.

Example 8

Ni—$TiO_2$ Composite Coatings on Mild Carbon Steel

A Ni—$TiO_2$ electroplating coating was deposited on mild carbon steel by adding a $TiO_2$ sol prepared as described in example 1 into a traditional Ni electroplating solution during electroplating and at a low and controlled rate. 12.5 ml/l of transparent $TiO_2$ sol solution was added into the electroplating solution, and then Ni—$TiO_2$ composite coatings were formed on carbon steels with a current of 50 mA/cm$^2$. Ni—$TiO_2$ coatings were prepared with solid $TiO_2$ nano-particles (diameter<25 nm) of 10 g/L for comparison.

Figure 26:
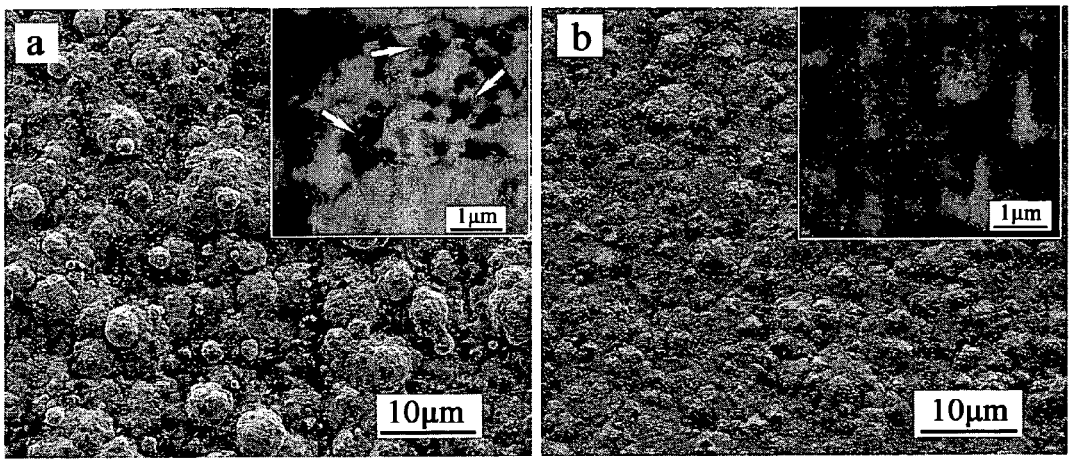
FIG. 26 shows surface second-electron morphologies of (a) a conventional Ni—$TiO_2$ composite coating, and (b) a novel sol-enhanced Ni—$TiO_2$ composite coating. The insets in (a) and (b) are locally magnified backscattered electron images.

FIG. 26 shows surface second-electron morphologies of: (a) a conventional Ni—$TiO_2$ composite coating, and (b) the sol-enhanced Ni—$TiO_2$ composite coating. The insets in (a) and (b) are locally magnified backscattered electron images. The traditional Ni—$TiO_2$ coating exhibited a quite rough and uneven surface (FIG. 26*a*). Large spherical Ni nodules with the size of ~4 μm were clearly seen, on which there were many superfine Ni nodules (~300 nm) as shown in the inset in FIG. 1*a*. Large clusters of $TiO_2$ nano-particles (~400 nm) were incorporated in the Ni nodules, as pointed by the arrows in the inset (BSE image). In contrast, the sol-enhanced Ni—$TiO_2$ composite coating had a much smoother surface (FIG. 26*b*). Two shapes of Ni nodules, i.e. spherical and pyramid-like, were displayed on the surface. The pyramid-like Ni nodules with ~1.5 μm size were relatively uniformly distributed in the spherical Ni nodules. It can be clearly seen from the inset in FIG. 1*b* that the size of the spherical Ni nodules was quite small, ~200 nm.

Figure 27:
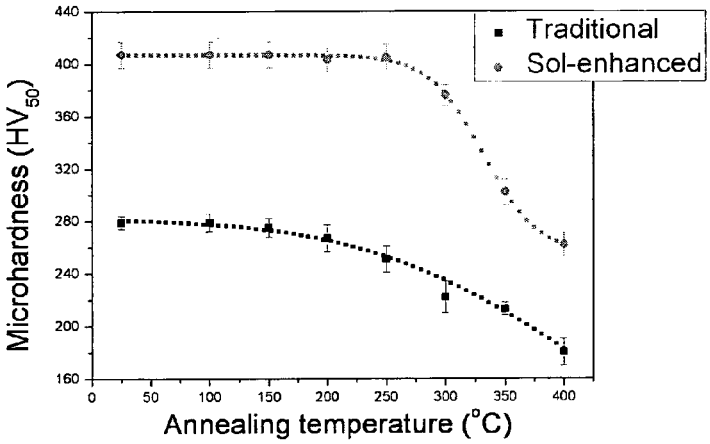
FIG. 27 shows the variation of microhardness as a function of the annealing temperature for a conventional Ni—$TiO_2$ composite coating and a novel sol-enhanced Ni—$TiO_2$ composite coating.

FIG. 27 shows the variation of microhardness as a function of the annealing temperature: ■—conventional Ni—$TiO_2$ composite coating; •—sol-enhanced Ni—$TiO_2$ composite coating. The as-deposited sol-enhanced coating possessed a high microhardness of ~407 $HV_{50}$ compared to ~280 $HV_{50}$ of the conventional coating. The microhardness of the conventional coating was ~280 $HV_{50}$ after low-temperature annealing (up to 150° C.), followed by a relatively steady decline to ~180 $HV_{50}$ when the coating was annealed at 400° C. for 90 min. In contrast, for the sol-enhanced coating, the high microhardness (~407 $HV_{50}$) can be stabilized up to 250° C.

Figure 28:
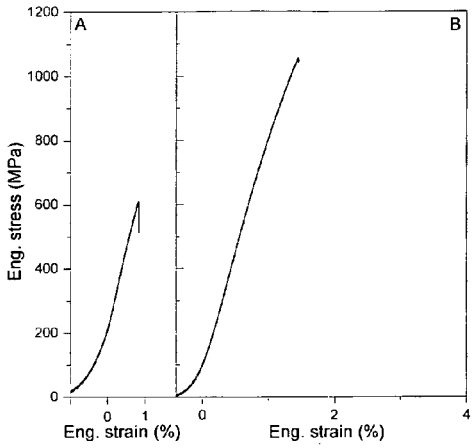
FIG. 28 shows the engineering stress-strain curves for (A) the conventional and (B) the sol-enhanced Ni-$TiO_2$ composites tested at a strain rate of $\mathbf{1\times10^{-4}s^{-1}}$.

FIG. 28 shows the engineering stress-strain curves for (A) the conventional and (B) the sol-enhanced Ni—$TiO_2$ composites tested at a strain rate of $1\times10^{-4}$ s$^{-1}$. The sol-enhanced composite shows a significantly increased tensile strength of ~1050 MPa with ~1.4% strain, compared to ~600 MPa and ~0.8% strain of the traditional composite.

Example 9

Au—$TiO_2$ Composite Coating on Ni-Coated Brass

A small amount of $TiO_2$ sol prepared as described in example 1 was added into the a conventional 1 electroplating Au solution, leading to the synthesis of Au—$TiO_2$ composite coatings. The microhardness and wear resistance were greatly improved as summarised in the table below.

Microhardness of traditional Au and sol-enhanced Au—$TiO_2$ composite coatings

| | Group I Condition: 10 mA/cm$^2$, 6.5 min | | Group II Condition: 50 mA/cm$^2$, 2.5 min | |
|---|---|---|---|---|
| | Microhardness ($HV_{10}$) | Wear volume loss ($\times10^{-3}$ mm$^3$) | Microhardness ($HV_{10}$) | Wear volume loss ($\times10^{-3}$ mm$^3$) |
| Conventional Au | 242 ± 6 | 1.58 ± 0.02 | 248 ± 4 | 1.62 ± 0.02 |
| Novel sol-enhanced Au | 269 ± 7 | 1.43 ± 0.02 | 293 ± 10 | 0.82 ± 0.03 |
| Improvement | 11% | 10.5% or reduced to 90% | 18% | 98% or reduced to 50.6% |

Figure 29:
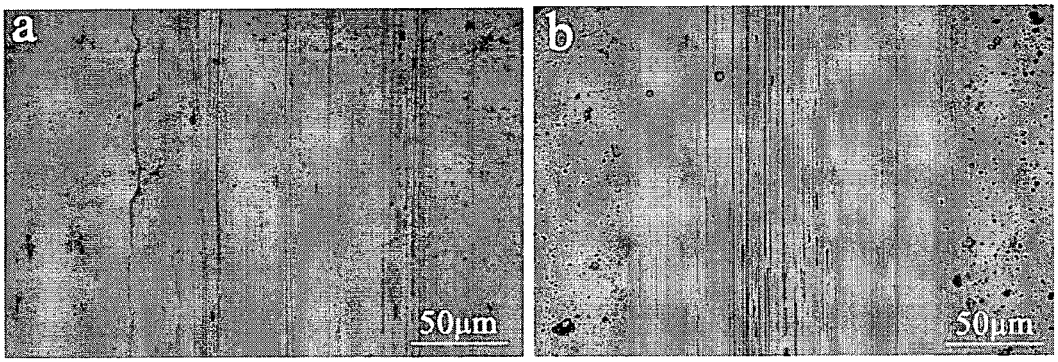
FIG. 29 shows wear tracks on (a) a conventional Au coating, and (b) a novel sol-enhanced Au coating.

FIG. 29 shows the wear tracks on (a) the conventional Au coating, and (b) the sol-enhanced Au coating. The electroplating was carried out with a current density of 10 mA/cm$^2$ for 6.5 min. The wear volume loss was measured and calculated from the width of the wear track. It was found that the wear volume loss of the conventional Au coating was ~$1.58\times10^{-3}$ mm$^3$, compared to ~$1.43\times10^{-3}$ mm$^3$ of the sol-enhanced Au coating.

Figure 30:
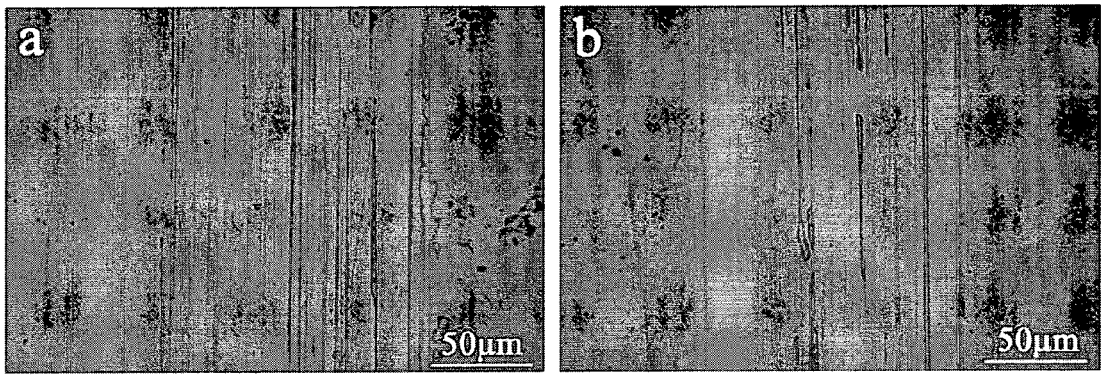
FIG. 30 shows wear tracks on (a) a conventional Au coating, and (b) a novel sol-enhanced Au coating.

FIG. 30 shows the wear tracks on (a) the conventional Au coating, and (b) the sol-enhanced Au coating. The electroplating was carried out with a current density of 50 mA/cm$^2$ for 2.5 min. It was calculated that the wear volume loss of the conventional Au coating was ~$1.62\times10^{-3}$ mm$^3$, compared to ~$0.82\times10^{-3}$ mm$^3$ of the sol-enhanced Au coating, indicating that the wear resistance of sol-enhanced coatings was significantly improved.

Example 10

Cu—$ZrO_2$ Composite Coating on Carbon Steel $ZrO_2$ sol prepared as described in example 7 was added into a conventional electroplating Cu solution, leading to the synthesis of Cu—$ZrO_2$ composite coatings. Cu and Cu—$ZrO_2$ (solid-particle mixing) coatings were also prepared with a concentration of $ZrO_2$ nano-particles (diameter<25 nm) of 10 g/L. The table below lists the microhardness and electrical resistance of the Cu, conventional (solid-particle mixing) and sol-enhanced Cu—$ZrO_2$ composite coatings. The sol-enhanced Cu—$ZrO_2$ composite coating had a significantly increased microhardness of ~153 $HV_{50}$ compared to ~133 $HV_{50}$ of the conventional Cu—$ZrO_2$ coating.

| | Electrical resistance ($\mu\Omega \cdot cm$) | Microhardness ($HV_{50}$) |
|---|---|---|
| Cu | 1.76 | 123 |
| Conventional Cu—$ZrO_2$ | 2.92 | 133 |
| sol-enhanced Cu—$ZrO_2$ | 2.33 | 153 |

Example 11

Cu—$Al_2O_3$ Composite Coating on Carbon Steel

Cu—$Al_2O_3$ composite coating was prepared by adding $Al_2O_3$ sol into a conventional electroplating Cu solution. The $Al_2O_3$ sol was synthesized with Al tri-sec-butoxide ($(C_2H_5CH(CH_3)O)_3Al$) as the precursor. A small amount of absolute ethanol was added to 1.7017 g of 97% Al tri-sec-butoxide in a beaker and the increment of mass of 8.0630 g was recorded as the weight of absolute ethanol. The mol ratio of aluminium iso-propoxide and water was 0.01:12.4. Under magnetic stirring, 158 mL of de-ionized water was slowly added into the mixture of Al tri-sec-butoxide and ethanol and a few drops of 30% nitric acid were added into the solution to adjust the pH value to 3.5. At this stage, the solution contained white precipitate and it was stirred on a hot plate of 60° C., until all white precipitate dissolved. Finally, a clear aluminium oxide sol was prepared.

Figure 31:
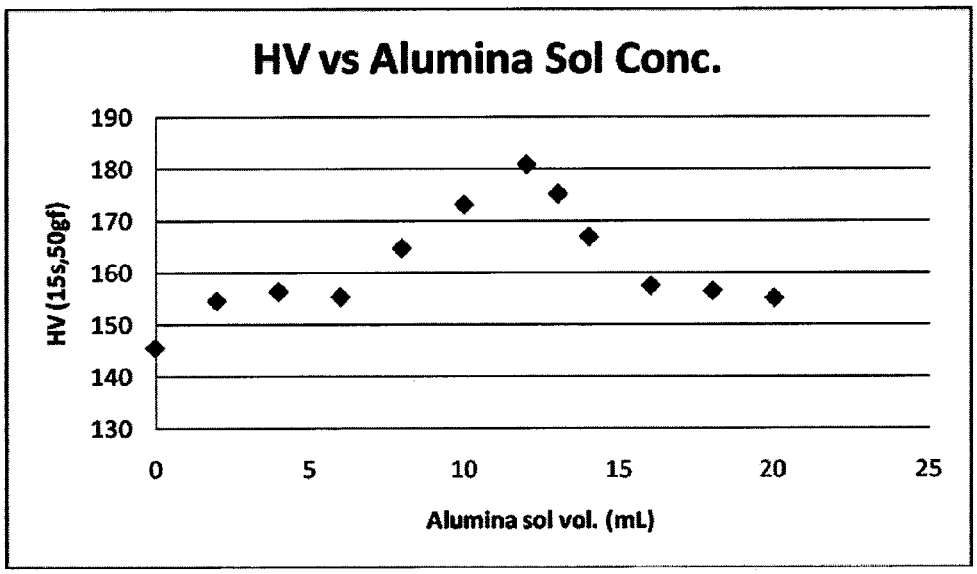
FIG. 31 shows the effect of $Al_2O_3$ sol concentration on the microhardness of coatings.

FIG. 31 shows the effect of $Al_2O_3$ sol concentration on the microhardness of coatings. The sol-enhanced Cu—$Al_2O_3$ coating has a peaking microhardness of ~181 $HV_{50}$ compared to ~145 $HV_{50}$ of the Cu coating, indicating ~25% improvement.

The foregoing describes the invention including embodiments and examples thereof. Alterations and modifications as will be obvious to those skilled in the art are intended to be incorporated in the scope hereof as defined in the accompanying claims.

The invention claimed is:

1. A plating or coating method for producing a metal-ceramic composite coating on a substrate, which includes adding a ceramic phase to the plating solution or electrolyte as a sol in an amount controlled to be sufficiently low that nanoparticles of the ceramic phase form directly onto or at the substrate, and continuously stirring the plating solution or electrolyte, wherein molecules of the ceramic phase exist in a net-structure in the sol, and wherein the metal-ceramic coating forms on the substrate with a predominantly crystalline structure.

2. A plating or coating method according to claim 1 comprising adding the sol at a rate of less than about 0.02 ml/liter of the plating solution or electrolyte.

3. A plating or coating method according to claim 1 comprising adding the sol by dripping the sol into the plating solution.

4. A plating or coating method according to claim 1 wherein the sol has a concentration such that the sol is transparent and particles of the ceramic phase are not visibly present in the sol.

5. A plating or coating method according to claim 1 comprising adding the sol at a controlled rate while carrying out the plating or coating and wherein the sol has a sol concentration of 20 to 250 grams of the ceramic phase per liter of the sol.

6. A plating or coating method according to claim 5 comprising adding the sol at a rate of 30 to 250 mls of sol per liter of the plating solution.

7. A plating or coating method according to claim 5 comprising adding the sol in a ratio of 0.5 to 100 mls of sol per liter of the plating solution.

8. A plating or coating method according to claim 5 comprising adding the sol in a ratio of 1.25 to 25 mls of sol per liter of the plating solution.

9. A plating or coating method according to claim 1 wherein the ceramic phase is a single or mixed oxide, carbide, nitride, silicate, boride of Ti, W, Si, Zr, Al, Y, Cr, Fe, Pb, Co, or a rare earth element.

10. A plating or coating method according to claim 1 wherein the ceramic phase comprises $TiO_2$, $Al_2O_3$, $ZrO_2$, or SiC.

11. A plating or coating method according to claim 1 wherein the coating, other than the ceramic phase comprises Ni, Ni—P, Ni—W—P, Ni—Cu—P, Ni—B, Cu, Ag, Au, Pd.

12. A plating or coating method according to claim 1 wherein the substrate comprises steel, Mg, Al, Zn, Sn, Cu, Ti, Ni, Co, Mo, Pb or an alloy thereof.

13. A plating or coating method according to claim 1 wherein the substrate comprises a mild steel, alloy steel, or carbon steel.

14. A plating or coating method according to claim 1 wherein the substrate comprises Mg or Al or an alloy thereof.

15. A plating or coating method according to claim 1 which is an electroless plating or coating process.

16. A plating or coating method according to claim 15 wherein the solution comprises as a reducing agent sodium hypophosphite, sodium borohydride, formaldehyde, dextrose, Rochelle salts, glyoxal, or hydrazine sulfate.

17. A plating or coating method according to claim 1 which is a galvanic plating process.

18. A plating or coating method according to claim 17 wherein the current density is in the range 10 $mA/cm^2$ to 300 $mA/cm^2$.

19. A plating or coating method according to claim 1 comprising adding the sol while carrying out the plating or coating and at a rate of sol addition controlled to be sufficiently low that nanoparticles of the ceramic phase form directly onto or at the substrate.

20. A plating or coating method according to claim 1 comprising adding the sol at a rate of less than about 0.07 ml/liter of the plating solution or electrolyte.

21. A plating or coating method for producing a metal-ceramic composite coating on a substrate which includes adding a ceramic phase to the plating solution as a sol in an amount controlled to be sufficiently low that nanoparticles of the ceramic phase form directly onto or at the substrate, and to substantially avoid formation of nanoparticles or microparticles of the ceramic phase, and/or agglomeration of particles of the ceramic phase, in the plating solution or electrolyte, and continuously stirring the plating solution or electrolyte, wherein molecules of the ceramic phase exist in a net-structure in the sol, and wherein the metal-ceramic coating forms on the substrate with a predominantly crystalline structure.

22. A plating or coating method according to claim 21 comprising adding the sol at a rate of less than about 0.02 ml/liter of the plating solution or electrolyte.

23. A plating or coating method according to claim 21 comprising adding the sol at a rate of less than about 0.07 ml/liter of the plating solution or electrolyte.

* * * * *